United States Patent [19]

Eickmann

[11] Patent Number: 4,624,174

[45] Date of Patent: Nov. 25, 1986

[54] MULTIPLE STROKE RADIAL PISTON MACHINE HAVING PLURAL BANKS OF CYLINDERS AND FLUID PRESSURE POCKETS ON THE PISTONS

[76] Inventor: Karl Eickmann, 2420 Isshiki, Hayama-machi, Kanagawa-ken, Japan

[21] Appl. No.: 601,392

[22] Filed: Apr. 17, 1984

Related U.S. Application Data

[60] Continuation-in-part of Ser. No. 344,110, Jan. 29, 1982, abandoned, which is a division of Ser. No. 119,349, Feb. 7, 1980, abandoned.

[51] Int. Cl.[4] ..... F01B 1/00

[52] U.S. Cl. ..... 91/485; 91/488; 91/492

[58] Field of Search ..... 91/485, 488, 491, 492

[56] References Cited

U.S. PATENT DOCUMENTS

| | | | |
|---|---|---|---|
| 2,111,659 | 3/1938 | Benedek | 91/497 |
| 3,142,229 | 7/1964 | Orshansky, Jr. | 91/492 |
| 3,155,010 | 11/1964 | Johnson et al. | 91/485 |
| 3,255,706 | 6/1966 | Eickmann | 91/488 |
| 3,280,757 | 10/1966 | Eickmann | 91/498 |
| 3,504,492 | 4/1970 | Newkirch | 91/485 X |
| 3,757,648 | 9/1973 | Eickmann | 91/492 X |
| 3,791,261 | 2/1974 | Eickmann | 91/492 X |
| 3,949,648 | 4/1976 | Eickmann | 91/492 |

FOREIGN PATENT DOCUMENTS

| | | | |
|---|---|---|---|
| 447172 | 3/1948 | Canada | 91/492 |
| 605440 | 5/1960 | Italy | 91/494 |
| 249940 | 12/1969 | U.S.S.R. | 91/488 |
| 432304 | 7/1975 | U.S.S.R. | 91/488 |
| 641150 | 1/1979 | U.S.S.R. | 91/492 |

*Primary Examiner*—William L. Freeh
*Assistant Examiner*—Paul F. Neils

[57] ABSTRACT

The former art provides multi stroke hydrostatic motors, which perform at a single revolution of the rotor multiple inward and outward strokes of the pistons. A high torque was thereby obtained. The invention discovers, that the known multi stroke motors are still too heavy, obtain small overall efficiencies and their power per size and weight is limited because the known motors failed to provide means to carry the tangential loads by fluid pressure power. The invention increases the power and efficiency of multiple stroke motors by the provisions of control means to control the flow of fluid pressure into pockets open to the piston faces and cylinder walls, whereby the torque of the rotor is transferred from the pistons to the cylinder walls by pressure in fluid in the pockets. The torque for rotating the rotor is produced by the high pressure fluid pressing each piston outwardly against the multi lobed cam and the torque is transferred from the piston's roller to the wall of the cylinder by means of a fluid pressure pocket in the respective piston. The invention also provides means to enlarge the stroke of the pistons in a given size and weight of the device. The fluid pressure pockets make high pressures possible and the angles of inclination of the guide faces can be increased. The torque of the device of a given size becomes multiplied and the efficiency of the device increases by the application of the provisions of the invention.

22 Claims, 47 Drawing Figures

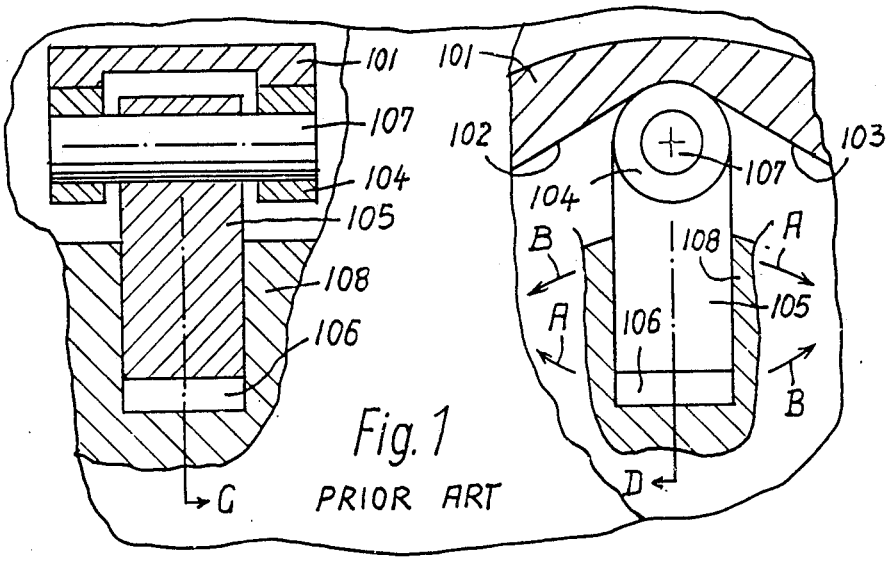
Fig. 1
PRIOR ART
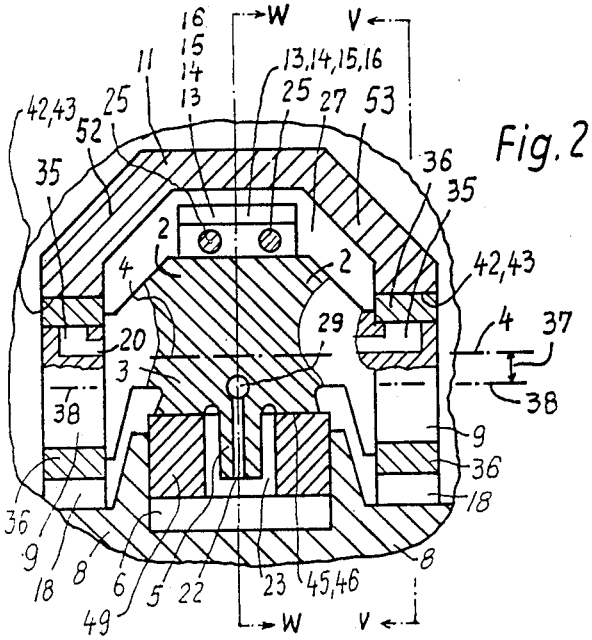
Fig. 2A
Fig. 2B
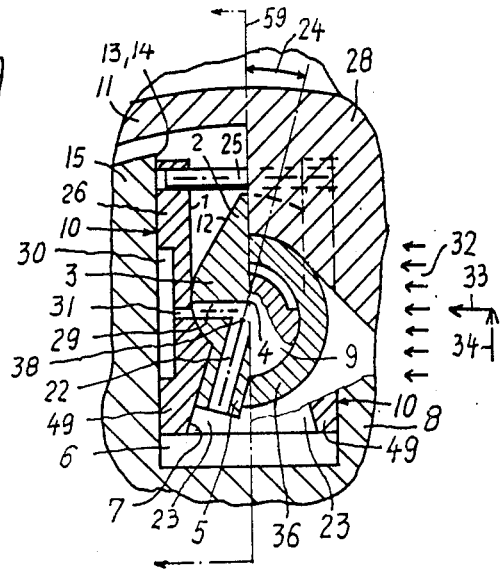
Fig. 3A
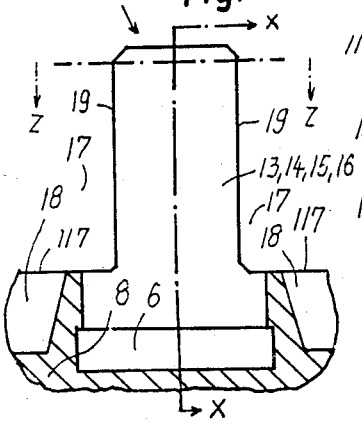
Fig. 3B
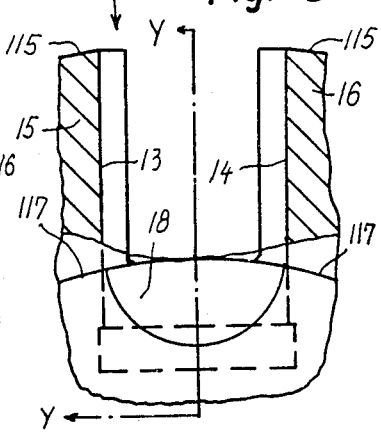
Fig. 3C
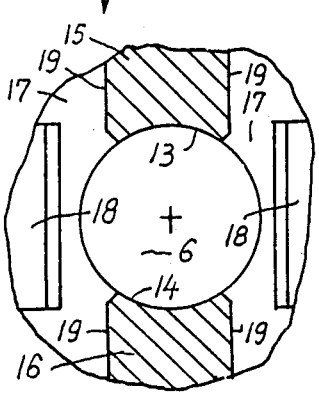

Fig. 14
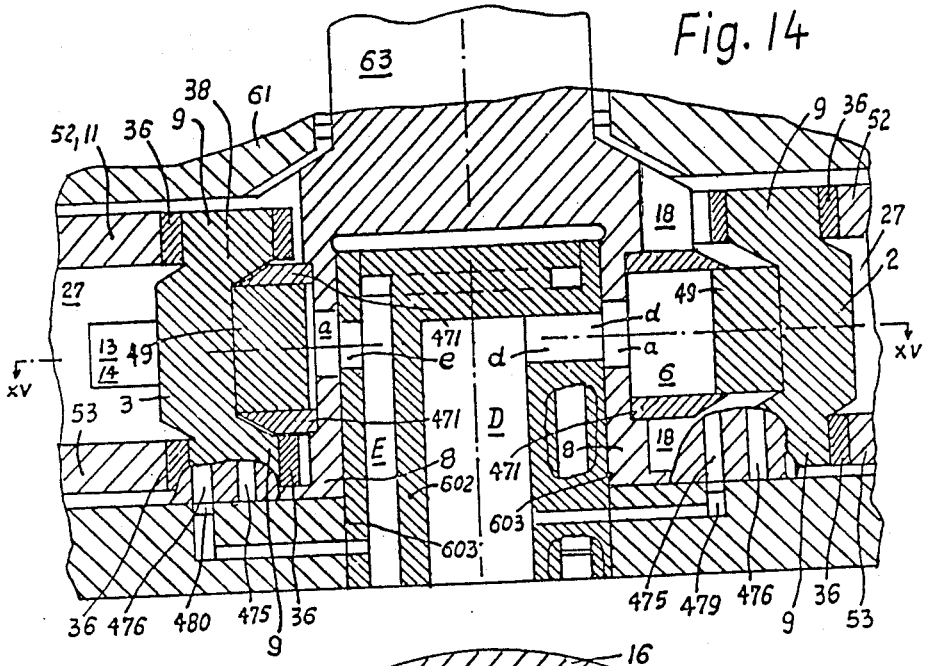
Fig. 15
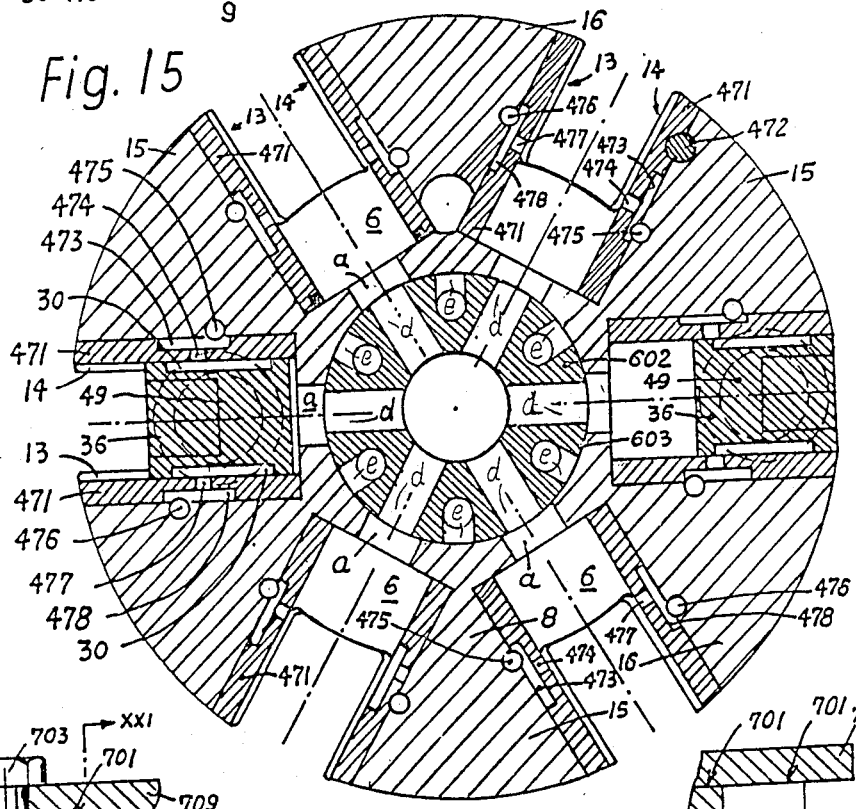
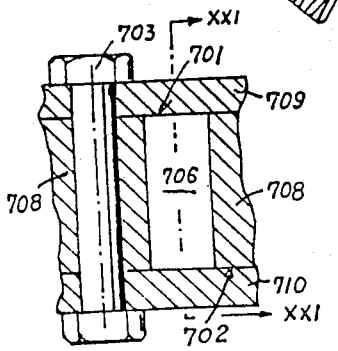
Fig. 20
Fig. 21
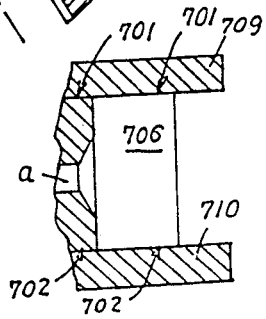

Fig. 25-A
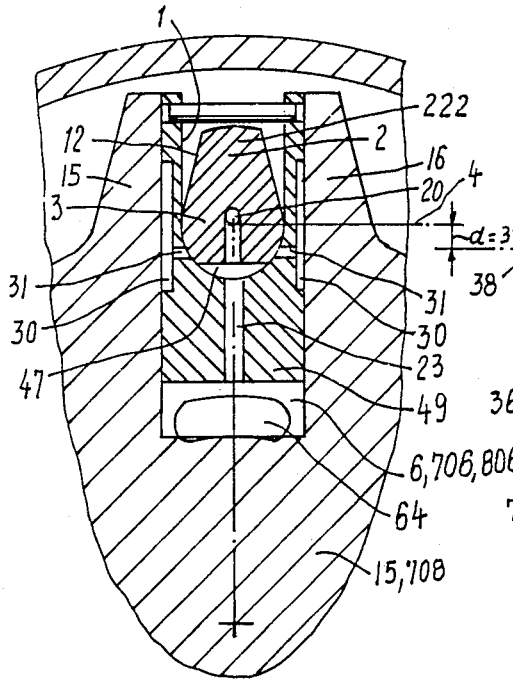
Fig. 25-B
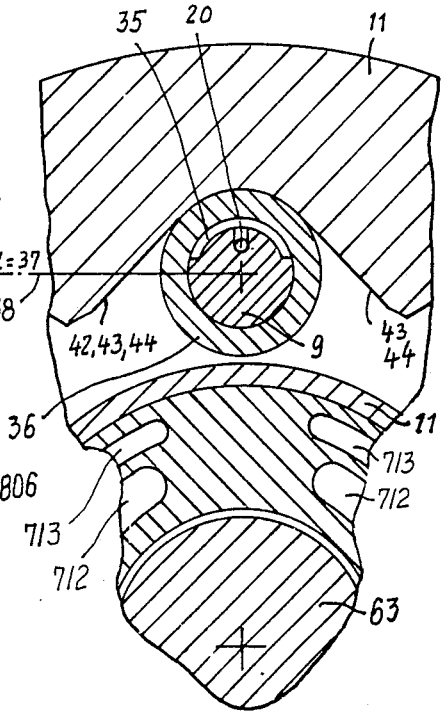
Fig. 22-A
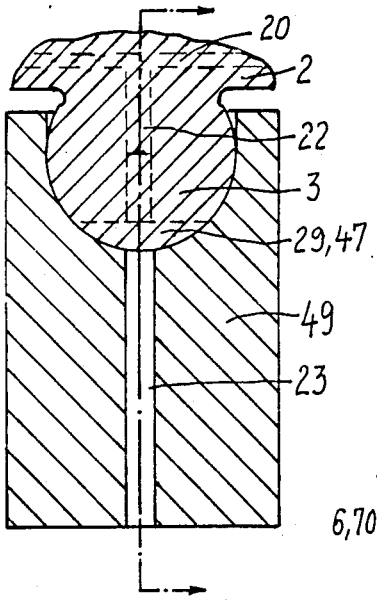
Fig. 22-B
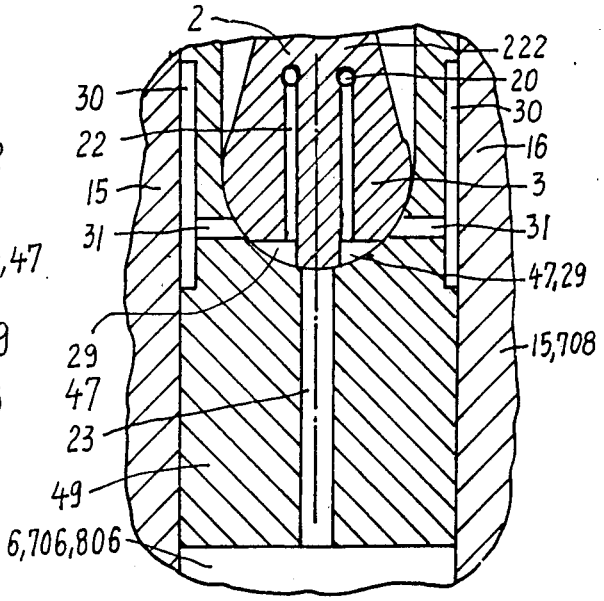

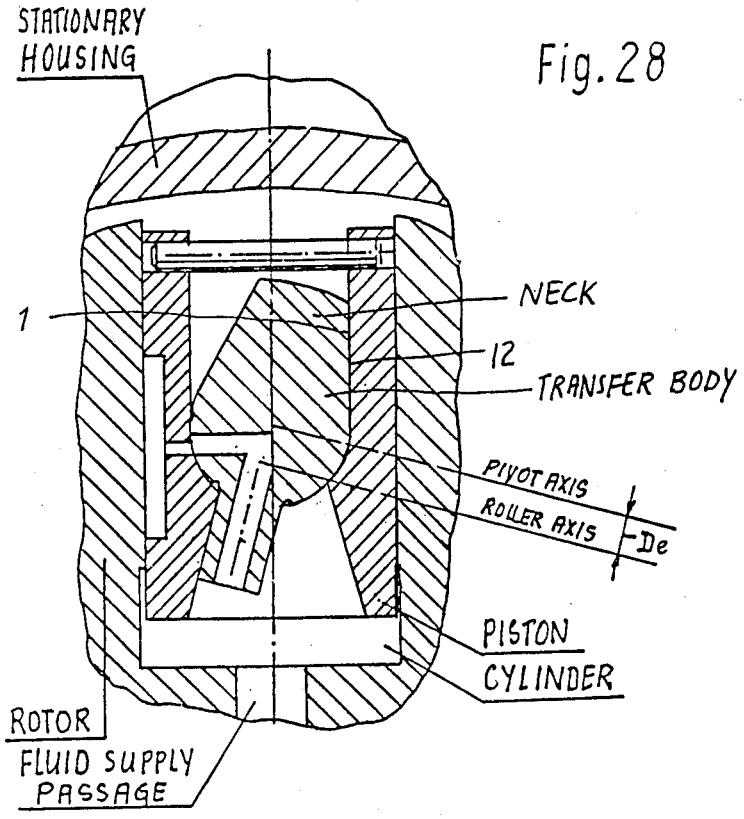
Fig. 28
Fig. 29
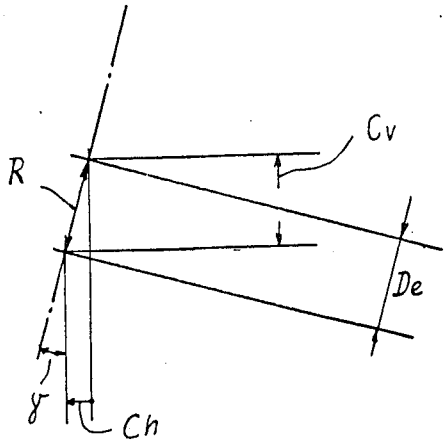

MULTIPLE STROKE RADIAL PISTON MACHINE HAVING PLURAL BANKS OF CYLINDERS AND FLUID PRESSURE POCKETS ON THE PISTONS

CROSS-REFERENCE TO A RELATED APPLICATION

This is a continuation in part application of my patent application Ser. No. 344,110 which was filed on Jan. 29, 1982 and is now abandoned.

Application Ser. No. 344,110 is a divisional of application Ser. No. 119,349, which was filed on Feb. 7, 1980; priority of which is claimed herewith. Application No. 119,349 is now abandoned.

BACKGROUND OF THE INVENTION

It is custom to use multi-stroke hydrostatic motors as high-torque motors. Compared to single stroke motors the multi-stroke motors give a higher torque.

After temporary successes and applications the number of multi-stroke motors has now decreased.

The invention therefore inquires deeply into the technology of multi-stroke motors and discovers the reasons why the common multi-stroke motors have lost so many applications.

After the mentioned deep inquiry into the reasons of partial failure, the invention discloses novel means, which increase the power and efficiency of multi-stroke motors or pumps so drastically, that the novel motors are now capable of higher power per size and weight and at the same time are capable of working with a higher overall efficiency.

FIELD OF THE INVENTION

The invention deals exclusively with fluid motors or pumps, wherein each piston performs at a single revolution of the rotor a plurality of power strokes and reciprocal strokes.

DESCRIPTION OF THE PRIOR ART

The prior art provides a number of multi-stroke motors, but seldom multi-stroke pumps. The multi-stroke device is especially suitable for high torque motors of not too many revolutions per unit of time.

In the former art the rotor has working chambers, commonly radially extending cylinders, wherein pistons reciprocate. The pistons extend outwards of the pistons and carry radially outwards of the rotor roller or other guide members which are rolling along a multi-stroke cam in the housing of the device. The multi-stroke cam is provided with inwardly and outwardly inclined faces, whereat the rollers run and thereby move the pistons inwards in the cylinders or allow them or force them to move outwards in the cylinders.

The inclination of the mentioned inclined faces actuates a tangential or lateral force onto the piston, when the piston is subjected to pressure in fluid in the respective cylinder. In other words, the radially directed force of the pressure in fluid in the cylinder onto the bottom of the respective piston is transformed into a radial and a tangential component of forces by the angle of inclination of the respective guide face of the stroke guide. The mentioned tangential component of force is sometimes also called a lateral force, because when seen in the direction of the axis of the piston, the tangential force acts not in the direction of the axis of the piston but laterally thereto. Seen in the overall structure of the device, the description as tangential force appears to be more proper, because the force acts in the direct direction of the torque, which is a tangential direction relative to the rotor.

The mentioned lateral or tangential component of force on the piston is during the power stroke of the piston transferred in the former art by the outer face of the piston onto the wall of the cylinder and thereby the rotor is revolved and obtains a torque.

LIMITATIONS OF THE FORMER ART

The multi-stroke motors of the former art are limited to rather softly inclined inward and outward guide faces, because steeply inclined guide faces would exert such a great tangential force onto the piston, that the piston would stick or weld to the cylinder wall, because the surface pressure between the faces would become too high. The oil film would become pressed away between the faces. This first limitation restricted the torque transferrable per piston of the unit.

The multi stroke motors of the former art had all the transfer means between the guide faces and the pistons outwardly of the rotor and this forced the radial dimensions of the device to become too large. The big radial diameters then forced the rollers to run with high speed along the guide faces. That built up friction forces in the rollers and caused the second limitation of the former art.

The transfer of torque by the mechanical outer faces of the pistons to the mechanical cylinder walls occurred under a bad friction coefficient. That also restricted the efficiency of the devices and provided the third limitation of the former art.

Since the transfer of tangential force took place radially outward of the cylinder, the piston tended under the lateral forces to tilt in the cylinder. That caused friction on the bottom portion of the outer face of the piston on one side and on the upper portion of the piston face on the other side. This friction was very considerable and caused the fourth limitation of the devices of the former art.

The tendency to tilt the pistons in the cylinders demanded a long piston guide within the cylinders and that again demanded a large radial size of the device and provided the fifth limitation of the former art.

Whatever the former art tried, it led to devices of large dimension per a given torque or power and every increase in pressure reduced the length of the piston stroke or increased the friction and thereby limited the capability of improvement of the former art devices, because the former art failed to discover the main causes of the limitations and unreliablities under higher pressures and strokes.

LIMITATIONS OF TRANSFER OF TECHNOLOGIES

There is reliable technology in the art of one-stroke devices, which perform a single power stroke at a single revolution of the rotor per piston. For example in a great number of my elder patents.

However, this technology could not be transferred from the one-stroke devices to the multi-stroke devices, because the one-stroke or single stroke-devices demand an annular guide face as guide face for the piston stroke. Piston shoes which have an outer face complementary to the mentioned annular guide face slid sealingly along the annular guide face. The piston shoes pivoted in beds in the pistons. The pivot-bars of the pistons shoes controlled a flow of fluid into fluid pressure pockets in the piston walls.

But, the multi-stroke motors or devices could obtain the multi-strokes only by the provision of non-annular guide faces, namely of those with outwardly and inwardly alternatingly inclined guide faces. Along these non-annular or non-circular faces, the outer faces of the piston shoes of single stroke devices could not slide without opening their fluid pressure pockets of the hydrostatic bearings in the outer faces of the piston shoes. Further, the piston shoes would have to pivot suddenly at change from inward to outward stroke under open hydrostatic bearings.

Thus, a combination of the former art of single stroke radial piston devices with multi stroke radial piston devices was not possible.

SUMMARY OF THE INVENTION

The invention discovers, that very drastic and novel steps must be taken in order to obtain an advancement of the multi-stroke devices. These steps have to be:

First: The stroke of the pistons must be increased per given size in order to increase the power.

Second: Tangential fluid pressure fields must be set between the piston walls and the cylinder walls in order to be able to carry the tangential load.

Third: Means must be found to control the flow of fluid pressure into the fluid pressure pockets at power strokes and to cut the supply of pressure off at the reciprocal strokes.

Fourth: The actuation area of the tangential load transfer onto the piston must be transferred from a location radially outward of the cylinder to a location inwards of a cylinder or along a cylinder wall portion.

Fifth: The inclination angle of the stroke guide faces must be increased for extremely high torque applications, and, Sixth: The means to improve the devices must be in balance with each other and complement each other in order that disturbance of one of the features by the other or others is prevented.

The invention now discovers the means, which can materialize the required steps and applies them singly or in most cases in combination.

The means, applied by the invention may be described in a concise form in the following concise description of the invention:

CONCISE DESCRIPTION OF THE INVENTION

In this specification and in its claims the word "pivotion" defines a "pivotal movement". The term "pivotion" is known in the patent literature from U.S. Pat. No. 4,387,866.

The means, arrangements, discoveries and solutions of the invention and thereby the objects of the invention and thereby the embodiments of the invention which are the solutions to the objects of the invention, are in detail:

The main object, the object "A" of the invention is to materialize in a radial piston device in combination: a housing, a rotor rotatably mounted in the housing, working chambers in the rotor, pistons reciprocable in the working chambers and along wall faces of the working chambers, inlet channels and outlet channels communicated to the chambers and to the housing, a stroke guide provided in the housing and radially of the chambers and pistons for the guidance of the strokes of the pistons, stroke transfer bodies mounted between the pistons and the stroke guide, control means for the control of flow of fluid to and from the working chambers, and multiple inward and outward guide faces on the stroke guide to guide the reciprocable pistons a plurality of times inward and outward in the chambers along the wall faces at each revolution when the rotor revolves;

that fluid pressure pockets are provided in the direction of a lateral load of the pistons, fluid pressure pockets are located between peripherial outer portions of the pistons and portions of the wall faces, control portions are provided to control the flow of fluid into the pockets and that control portions act in timed relation to the movements of stroke transfer bodies along the outward and inward guide faces of the stroke guide.

Another object, the object "B" of the invention is to provide to object "A" that stroke transfer bodies are borne on bearing beds in the pistons.

A further object, the object "C" of the invention together with object "A" is, that stroke transfer bodies have ends, which carry members with an ability to move along the outward and inward guide faces of a stroke guide.

Still another object, the object "D" together with object "C" of the invention is to provide that members are laterally distanced from the respective longitudinal axis of the respective piston of the pistons.

Still another further object, the object "E" together with object "B" of the invention is that stroke transfer bodies include bearing faces of a configuration complementary to the configuration of the bearing beds and the bearing faces are slidably borne on the bearing beds.

A further object, the object "F" of the invention is that the bearing faces are shorter than the diameters of the pistons;

the bearing faces are provided on bearing portions of the stroke transfer bodies, the bearing portions are shorter than the diameters of the pistons, and, the bearing portions and bearing faces are located within the outer diameters of the pistons.

Still another object, the object "G" together with object "B" of the invention is that the bearing portions and the bearing beds at least partially and temporarily enter into the working chambers in order to provide the possibility of large piston strokes.

A still further object, the object "H" together with object "A" of the invention is that the rotor is provided with radial extensions, the rotor has radially reduced outer diameters endwards of the extensions, the extensions form extended working chamber wall-faces to form thereby extended piston-stroke guide faces, and, the outer faces of the pistons are at least partially and temporarily moved and guided along the guide faces of the radial extensions.

Another object, the object "J" together with object "A" of the invention has as aim that the working chambers and pistons are of rectangular cross-sectional configuration in order to increase the quantity of flow of fluid through the working chambers at each revolution of the rotor.

Another object, the object "K" together with object "E" of the invention secures that bearing beds are provided with radially outwardly extending face portions, the pistons are provided with radially outwardly extending piston portions, the face portions are partially provided on the piston portions, the bearing portions of the stroke transfer bodies are provided with radially extending necks, the radially extending necks are partially narrower than the distance between the radially extending face portions, and, the necks are able to pivot in a limited extent between the face portions of the piston portions.

Another object, the object "L" together with object "K" of the invention is, that the neck and its configuration in combination with the face portions and the piston portions define a definite limit of the angle of pivotal movement of said neck between said face portions and the necks are kept by the face portions and piston portions in their maximum of pivotal direction when the stroke transfer bodies move along a respective outward guide face of the stroke guide, whereby the maximum of pivotal direction is maintained by the stroke transfer bodies at the movement along the respective outward guide face.

A further object, the object "M" together with object "K" of the invention is to provide, that the stroke transfer bodies and the necks are utilized to define and actuate respective control portions for the control of flow of fluid into the pockets.

A further object, the object "O" together with object "L" of the invention is, that bearing portions are provided with flow-control recesses which interrupt the bearing faces, the pistons are provided with first passages to extend from the working chambers through the pistons into the recesses, second passages are provided through portions of the pistons to extend from the bearing beds to the pockets, the second passages are located at definite places in order that the control recesses are able to alternately open and close the second passages when the bearing portions pivot in the beds, and, the flow-control recesses communicate the first and second passages when the pistons do power strokes when they oscillate in the working chambers; while the lateral forces acting during the power strokes on the pistons are at least partially carried by pressure in fluid in the pockets when the passages are communicated by the recesses.

Another object, the object "P" together with object "O" of the invention provides, that flow control recesses communicate the first and second passages through the pistons and thereby the pockets with the working chambers when the pistons do outward strokes at the reciprocation in the working chambers, fluid under pressure is led into the working chambers at location of the working chambers and pistons below the outward guide faces of the stroke guide, fluid under pressure forces the pistons in the chambers outward and the stroke transfer bodies along the outward stroke faces to revolve the rotor, whereby the device acts as a motor and the pockets transfer the force and pressure in fluid against the respective portions of the wall faces, whereby the torque of the motor is transferred from the pistons by fluid pressure in the pockets, acting against the wall faces of the cylinders of the rotor.

Another object, the object Q together with object "H" of the invention insists, that fluid pressure pockets are provided in the walls of the working chambers, a control body portion for multiple alternation of control of flow of fluid during each revolution of the rotor is provided in the device, the control body portion includes multiple pressure control parts and unloading controlports, passages are extended from the pockets through portions of the rotor to port into a control means provided on the rotor, and, the control body portion meets the passages alternately to pass fluid from the pressure control ports through the passages into the pockets at power strokes of the pistons and to unload the pockets from pressure in fluid by communicating the unloading control ports with the passages and thereby the pockets with the unloading controlports when the pistons do strokes in opposite direction relative to the power strokes.

A further object, the object "R" together with object "A" of the invention provides a plurality of working chamber groups with pistons therein and pluralities of the stroke guides are provided in the device axially of each other.

According to another object, the object "S" together with object "R" of the invention one of the groups acts in power strokes at times when another of the groups acts in opposite strokes relatively to the power strokes.

A further object, the object "T" together with object "A" of the invention provides, that working chambers are located distanced from the axis of the rotor and extend parallel to each other deep into the rotor beyond the medial portion of the rotor to permit extremely large piston strokes of the pistons.

In accordance with another object, the object "U" together with object "H" of the invention, the pistons perform strokes of a length which is longer than one tenth of the diameter of the rotor, whereby the device obtains an extremely high power for its weight and size.

A further object, the object "V" together with object "A" of the invention provides that inward or outward guide faces of the stroke guide form angles of inclination relative to the radial axes of the working chambers in the range of twenty to sixty degrees, and fluid pressure pockets are provided along portions of the outer faces of the pistons and the wall faces of the chambers are suitably sized and located to be able to carry the major portion of the tangential load transferred from the inward or outward guide faces of the stroke guide to the pistons, whereby the device is able to handle an extremely high torque by the rotor in a given weight and size of the device.

According to another object, the object "W" together with object "V" of the invention the fluid pressure pockets are suitably dimensioned and located to permit the device to handle the extremely high torque at a high efficiency.

A further object, the object "X" together with object "H" of the invention is, that the extension extends between endwards located faces of the outward and in ward guide faces partially beyond the guide faces into a space provided between portions of the stroke guide and the endwards located faces.

According to the next object, the object "Y" together with object "H" of the invention the stroke guide includes a medial portion and end portions on the ends of the medial portion, the guide faces of the stroke guide are provided on the end portions, the medial portion provides a recess extending beyond the guide faces radially into the stroke guide, the radial extensions of the rotor at least temporarily enter into the recess in the medial portion, the stroke transfer bodies have medial parts and end parts on the ends of the medial parts, the medial parts include power-transfer centers, the power transfer centers are located in the pistons and at the major portion of the strokes of the pistons between said radial extensions of the rotor and the end parts of the stroke transfer bodies carry engagement means to engage the guide faces of the stroke guide and to guide the power transfer bodies and the pistons substantially parallel to the outward and inward guide faces of the stroke guide.

The next object, the object "Z" together with object "Y" of the invention provides that the engagement means are rolling rings with cylindrical inner and outer roller faces, the end parts are cylindrical bars with cylindrical outer faces of a configuration complementary and fitting to the inner faces of the rolling rings, the end parts of the stroke transfer bodies contain fluid pressure pockets communicated by passages through portions of the stroke transfer bodies to the medial part and through the medial part to a space which contains fluid under pressure, the outer roller faces roll along the guide faces and the inner roller faces slide along the end parts and are at least partially radially borne by the pressure in fluid in the pockets in the end parts of the stroke transfer bodies.

According to a further object, the object "Z1" together with object "Y" of the invention the stroke transfer bodies carry on their axial ends endwards of the pistons peripherally distanced roller-pairs, the stroke transfer bodies include medial parts between the end parts, the medial parts are pivotably borne in bearing beds in the pistons, the roller pairs roll along the guide faces of the stroke guide and the stroke transfer bodies pivot in the beds when the axes of the roller pairs move substantially parallel along the guide faces of the stroke guide.

Another object, the object "Z2" together with object "A" of the invention provides, that the pistons carry roller—pairs to permit the rollers of the roller pairs to revolve around second axes of the pistons, the second axes of the pistons are normal to the longitudinal axes of the pistons and means are provided to keep the second axes parallel to the axis of the rotor, the rollers of said roller pairs roll along the guide faces of the stroke guide and fluid pressure pockets are provided between the pistons and the walls of the chambers and communicated to fluid under pressure and cut off from fluid under pressure alternately parallel to power strokes and non-power strokes of the pistons without pivoting of the stroke transfer bodies on the pistons.

A further object, the object "Z3" of the invention provides radial piston device including a housing, a rotor and a stroke guide for pistons in working chambers of the rotor, wherein a transmission means is provided which revolves that stroke actuator relatively to the rotor a plurality of revolutions at each single revolution of the rotor, whereby the pistons perform multiple strokes in the device at each single revolution of the rotor of the device.

Another object, the object "Z4" of the invention provides a radial piston device including reciprocable pistons in cylinders having a longitudinal axis and a bore along a second axis, wherein the second axis is normal to the longitudinal axis and parallel to the axis of the rotor wherein the cylinders are provided, wherein a bar extends through the bore and on both ends out of the bore to provide bar-ends which carry slide shoes, and the slide shoes have fluid pressure pockets, provided in outer faces which slide along a stroke guide faces, while the slide shoes are fastened by arresting means against excessive rotation relative to the bar on the bar, passages extend from the pockets through the bar to a recess between the bar and the piston within the piston and from the recess through the piston into the respective cylinder of the cylinders to fill the pockets and the recess with fluid under pressure at power strokes of the pistons.

A still further object, the object "Z5" together with object "Z4" of the invention provides a device wherein fluid pressure pockets are provided between the walls of the cylinders and the outer faces of the pistons which can be alternately communicated to a recess to uniformly provide all of the pockets with pressure in fluid at suitably to each other related times of power strokes of the pistons.

Another object, the object "Z6" of the invention proposes a cylindrical control body for radial flow of fluid into working chambers of a fluid handling device which contains control body in a hub of the rotor of the device, wherein a space extends through the control body normal to the axis of the controlbody and the space contains in the space substantially along the axis of the space moveable thrust members which have outer faces in sliding engagement with the inner face of the rotor hub, pass fluid to and from the working chambers through passages in the thrust members, have a thrust chamber between said thrust members and hydrostaticly balancing fluid pressure pockets in relatively opposite thrust members, and, wherein the thrust members are pressed against the face of the rotor hub for sliding engagement thereon by pressure in fluid in the thrust chamber when the device operates under power.

A still further object, the object "H2" together with object "H" of the invention considers and discloses a device wherein the stroke transfer bodies extend axially in both directions beyond the pistons, to form stroke transfer ends, wherein the ends form pairs of bearing portions, while the bearing portions of each pair form one forwardly located bearing portion and one rearwardly located bearing portion, and each of said bearing portions carries a rolling member, whereby four rolling members associated to each respective piston and transfer body are rolling along pairs of inward and outward guide faces of the stroke guide in order to define by the rolling under the influence of the configuration of the guide faces of the stroke guide the inclination of pivotion of the transfer bodies to thereby provide and control the flow of fluid into the pockets and the action in the timed relation of the control portions.

Another object, the object "Z7" of the invention is to provide in a radial piston machine, in combination, pistons and piston shoes, a rotor and a stroke guide, wherein the rotor has medial radial extensions between end portions of restricted diameter, the piston shoes have bearing portions which are pivotably borne in beds of the pistons and recesses between axial ends peripherially endwards of a medial portion of the piston shoes for the entrance of the medial radial extensions of the rotor into the recesses of the shoes in order to permit a long stroke of the pistons, the axial length of the piston shoes parallel to the axis of the rotor is substantially limited to the diameter of the respective associated piston of the pistons, the medial portions of the piston shoes are substantially about 45 percent in length of the diameter of the pistons, the end portions of the shoes endwards of the medial portions of the shoes are roughly about a length of about 27.5 percent of the diameters of the pistons, fluid pressure pockets open to the radial outside are provided in the ends of the piston shoes and extended very considerably in the end faces, whereby the piston shoes carry the radial load thereof substantially within the axial extent of the diameter of the respective piston to prevent deformation of the axial ends of the shoes and to permit axially short rotors.

A still further object, the object "Z8" of the invention deals with devices wherein the rotors have flow-through passages from the rotor hub to the working chambers of a cross-sectional area less than the cross-sectional area of the respective chamber of the chambers to provide forces on the bottoms of the chambers in a direction towards a control body with thrust members in thrust chambers in the control body, while the axial extension of the thrust members is limited to a size to obtain and maintain a seal along the rotor in reaction and in relation to the forces on the bottoms of the chambers and in proper dimensioning respective to the cross-sectionally reduced rotor passages and wherein thereby the balancing recesses in the thrust members are spared and eliminated from the thrust members and the control body.

Another object, the object "Z9", for example, together with objects "Z4" or "A" of the invention provides that the bars and the shoes have recesses endwards of the respectively associated pistons and the recesses extend from the radial inside into said bars and into the slide shoes to make an entrance of portions of walls of the cylinders into the recesses possible in order to obtain a long stroke of the pistons in the cylinders.

According to a further object, the object "H3" together with object "H" of the invention the wall face portions form piston-guide- and support-faces, whereby they also form torque- and power-reception faces, the extensions and segments of the rotor form torque-transfer portions and said fluid pressure pockets form torque-thrust- and transfer-means.

A still further object, the object "L2" together with objects "K" and/or "L" of the invention provides that the stroke transfer bodies carry members which move along the guide faces of the stroke guide, the transfer bodies and the pistons have centers of pivotion=pivotal movements, the members which move along said faces are mounted around radially inner axes of parallelity to the axis of the rotor and the eccentricities extending radially inward from the centers of pivotion are provided between the centers of pivotion and the radially inner axis.

Still another object, the object "L3" together with object "L2" of the invention discloses that the eccentricity and the inner axis are provided to actuate the pivotion under the respective forces when the members move along the guide faces of said stroke guide.

A further object of the invention considers and proposes in a radial piston machine in combination, a rotor, cylinders in the rotor, pistons reciprocable in the cylinders, a stroke guide to guide the strokes of the pistons, piston shoes between the pistons and the stroke guide borne in beds in the pistons and able to pivot in the beds as well as passage means and control means to lead and control flow of fluid into and out of the cylinders, the pistons have radial extensions which extend beyond the piston shoes and distance parts are provided radially of the piston shoes between the extensions of the piston shoes while the distance parts are rigidly fastened to the extensions of the pistons to form a rigid outer assembly radially of the piston shoes on the pistons to prevent deformations of the extensions of the pistons.

And, a last object, the object "Z11" of the invention is to provide in a radial piston machine, in combination, a rotor, cylinders in the rotor, pistons reciprocably in the cylinders, a stroke guide to guide the strokes of the pistons, piston shoes pivotably borne in beds of the pistons and provided between the pistons and the stroke guide and passage- and control- means to lead and control flow of fluid into and out of the cylinders, the piston shoes have outer faces to slide along inner faces of the stroke guide, the piston shoes are pivoting in the beds of the pistons around a center of pivotion, while the piston shoes have peripherial extensions which provide portions of the outer faces and extend in the directions of movement along the inner face and the distance of the center of pivotion is short in comparison to the peripherial length of the peripherial extensions to form small angles from the tips of the extensions to the centers of pivotion to prevent undesired instability or partial escape from close engagement of the outer faces from the inner faces, when the outer faces slide along the inner faces.

BRIEF DESCRIPTION OF THE DRAWINGS

FIG. 1 shows in section a sample of the former art.

FIG. 2 shows in sectional views one embodiment.

The word "embodiment" defines in this application an embodiment of the invention.

FIG. 3 shows a piston of an embodiment in sectional views.

FIG. 4 shows other portions of an embodiment in sectional views.

FIG. 5 demonstrates a stroke transfer body of an embodiment.

Figure 4B:
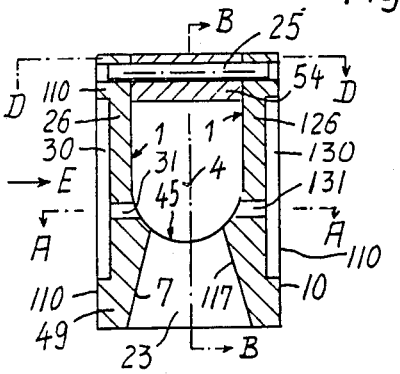
Figure 4A:
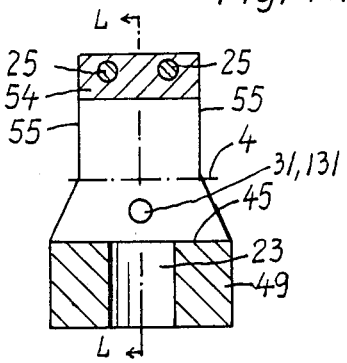
Figure 4D:
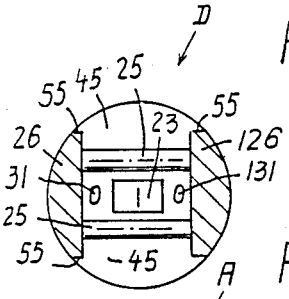
Figure 4C:
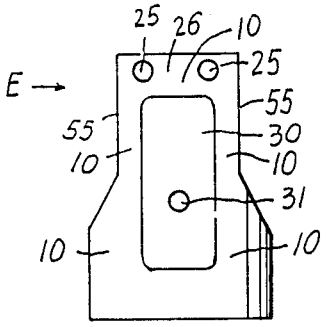
Figure 4E:
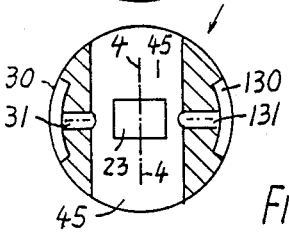
Figure 5B:
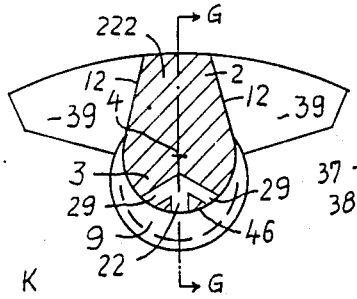
Figure 5A:
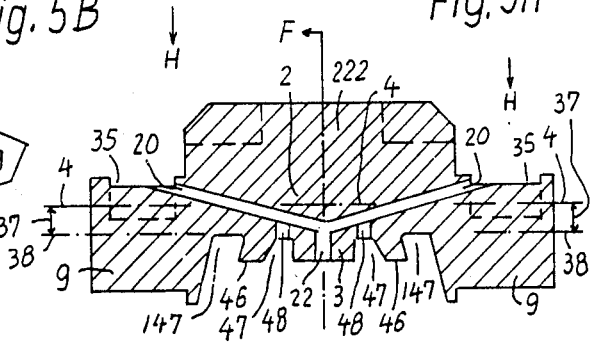
Figure 5D:
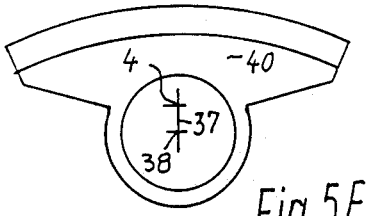
Figure 5E:
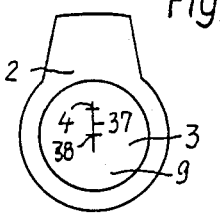
Figure 5C:
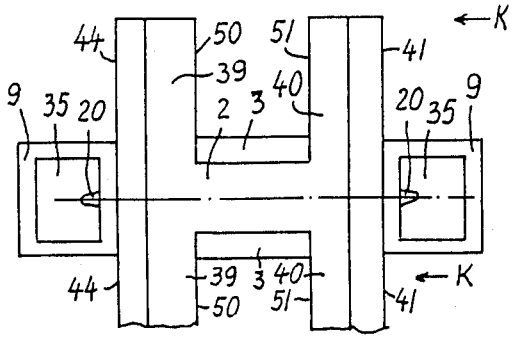
Figure 6:
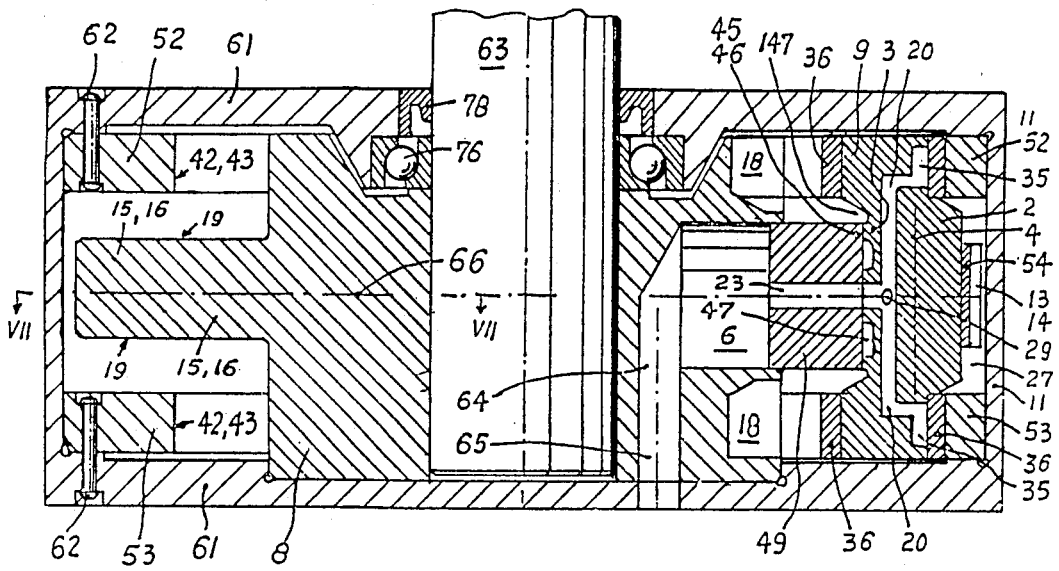

FIG. 6 is a longitudinal sectional view through an embodiment.

Figure 7:
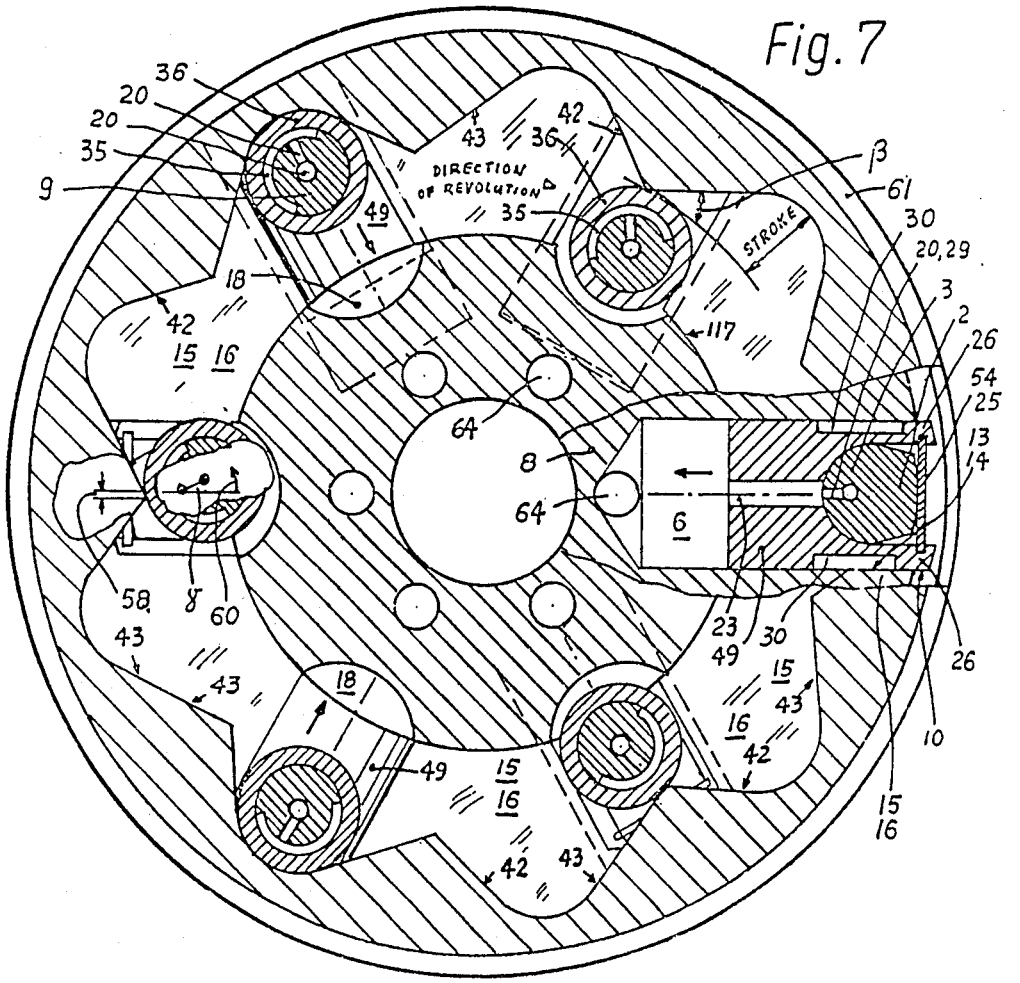

FIG. 7 is a sectional view through FIG. 6 along line VII—VII.

Figure 8:
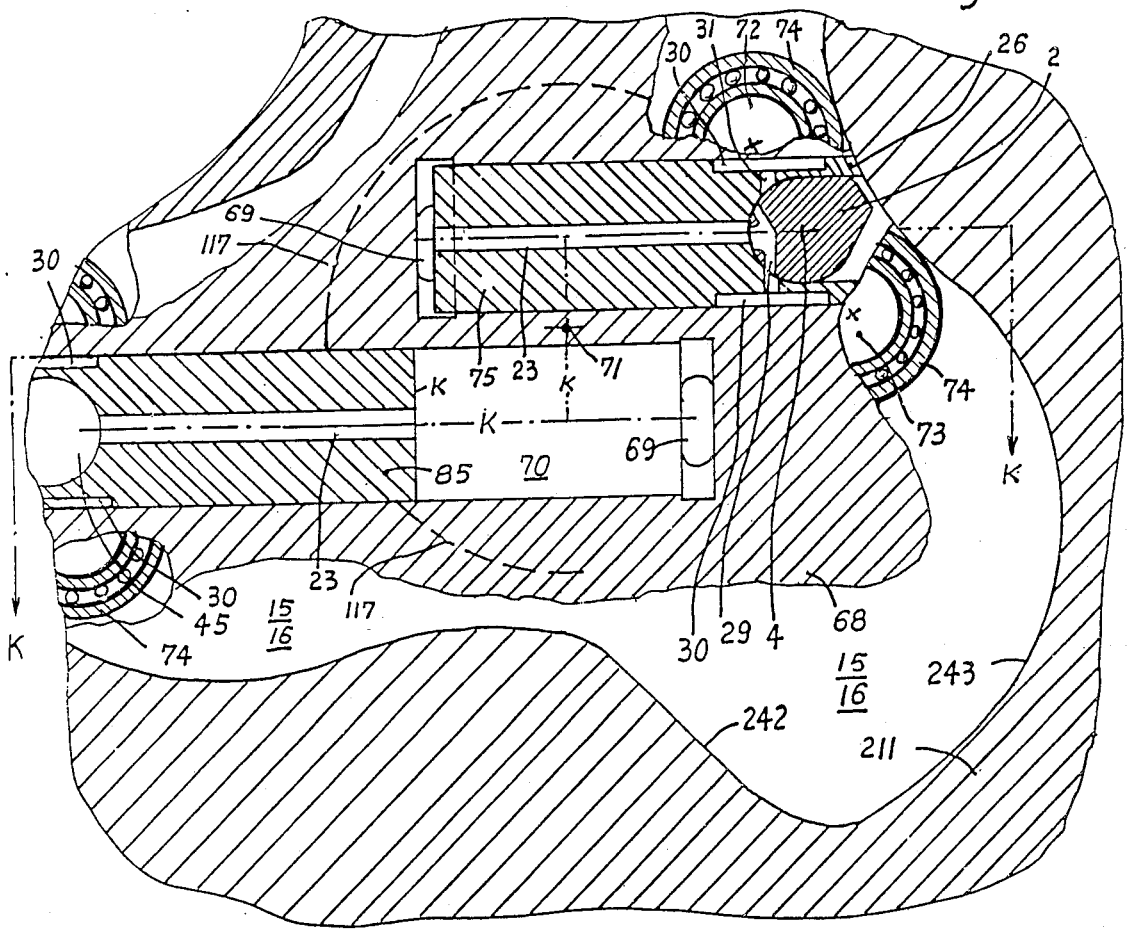

FIG. 8 also shows a longitudinal sectional view through an embodiment.

Figure 9:
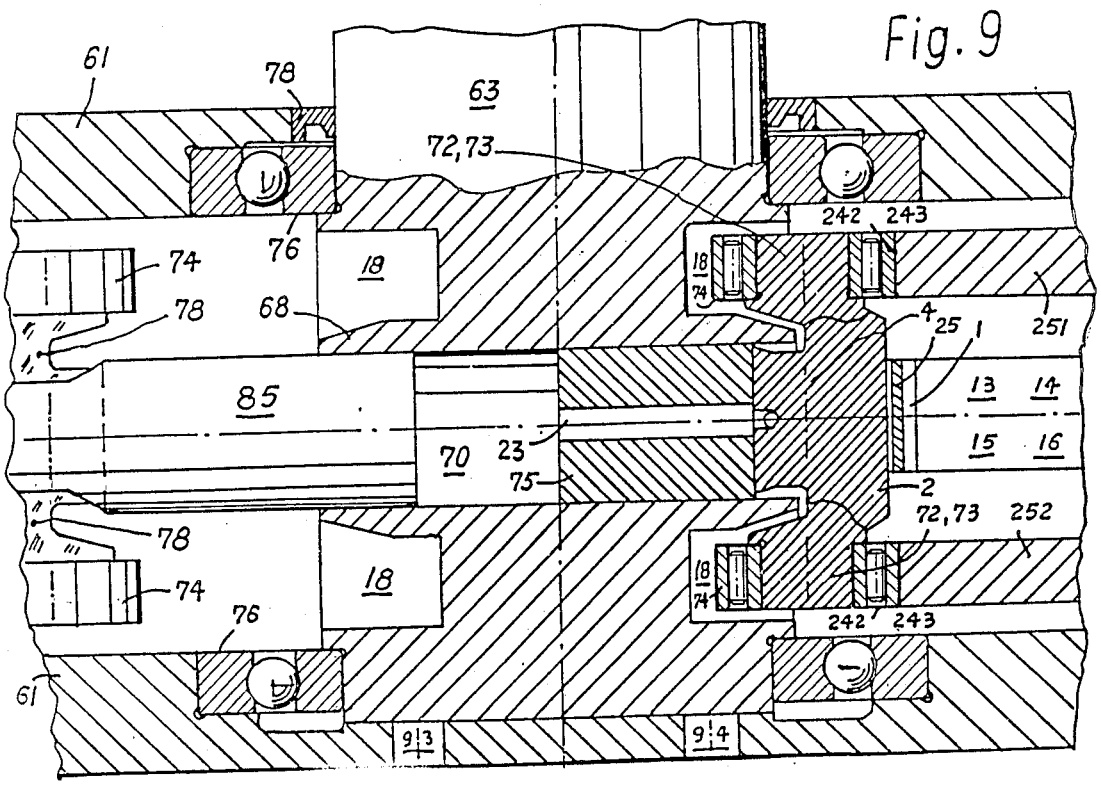

FIG. 9 is a sectional view through FIG. 8 along line K—K.

Figure 10:
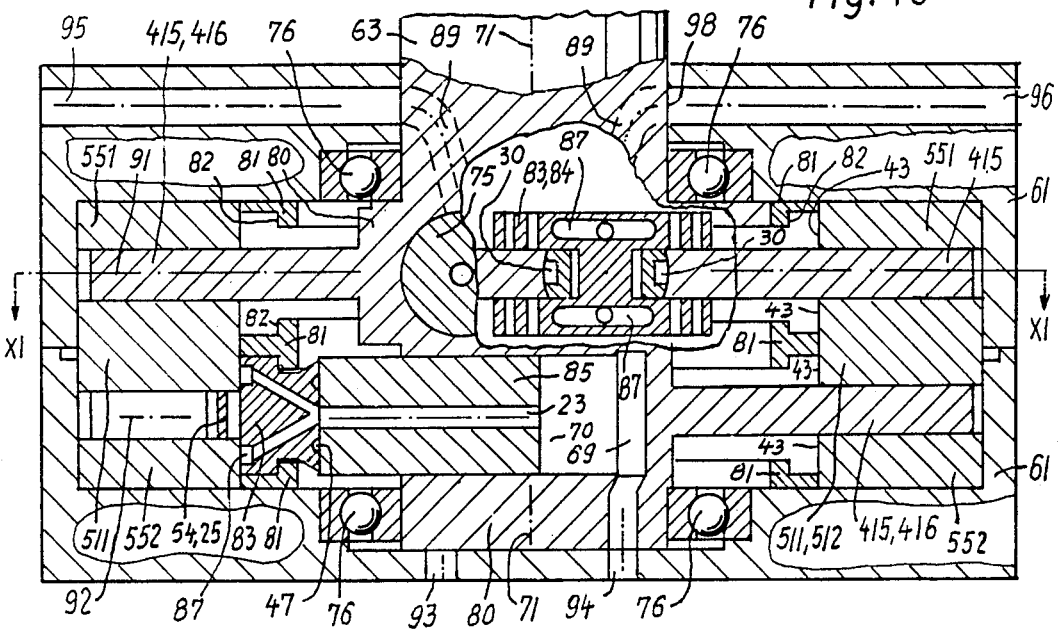

FIG. 10 is a longitudinal sectional view through an embodiment.

Figure 11:
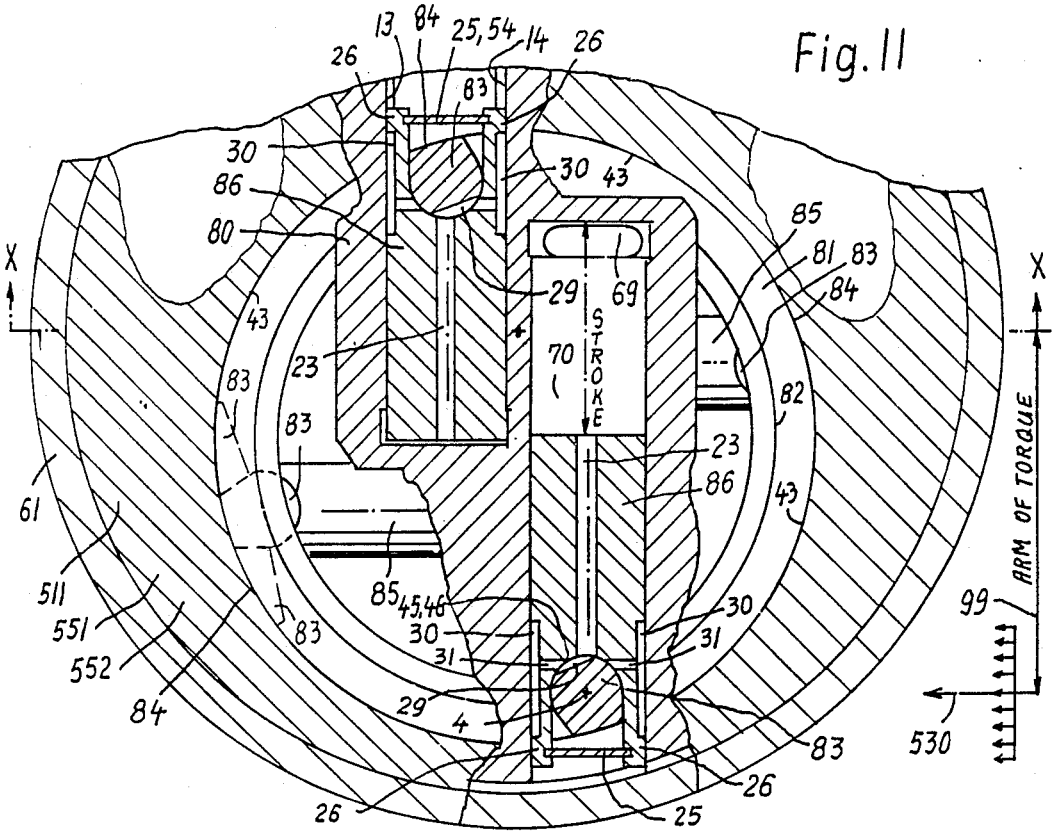

FIG. 11 is a sectional view through FIG. 10 along line XI—XI with the exception, that the section through members 511, 551,522 runs partially parallel to the line with arrows XI—XI of FIG. 10.

Figure 12:
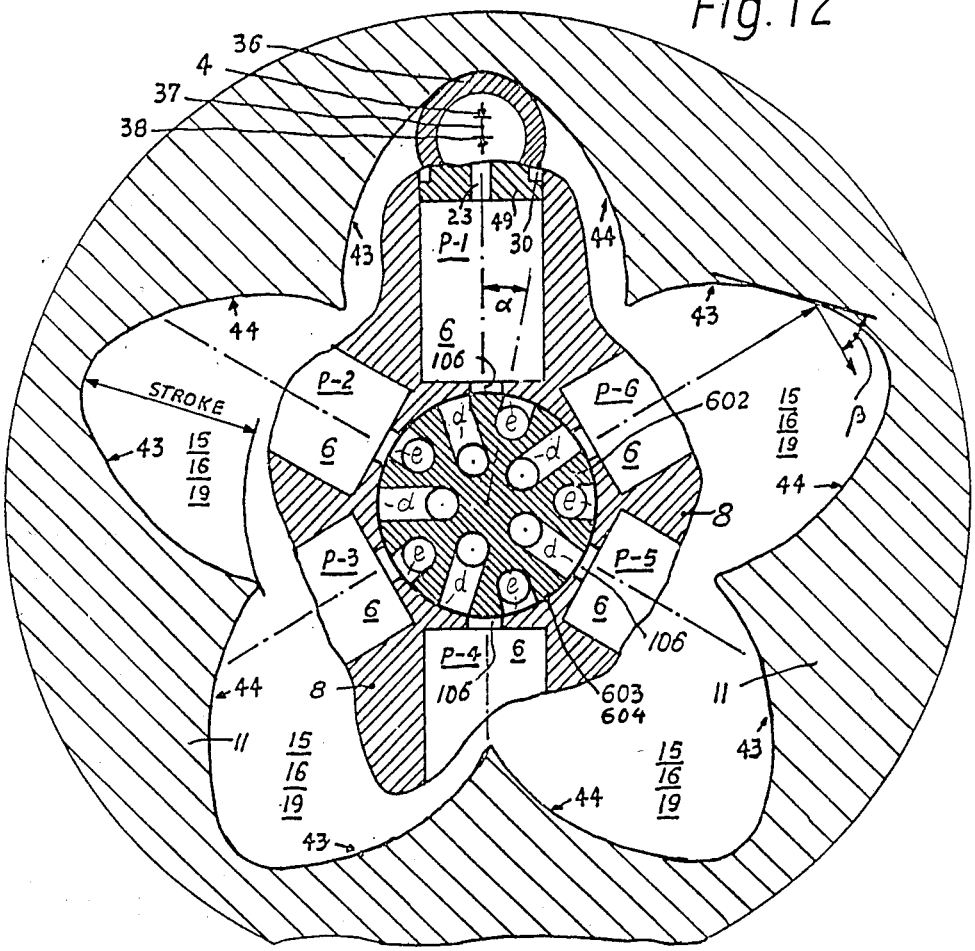

FIG. 12 is a cross-sectional view through another embodiment.

Figure 13:
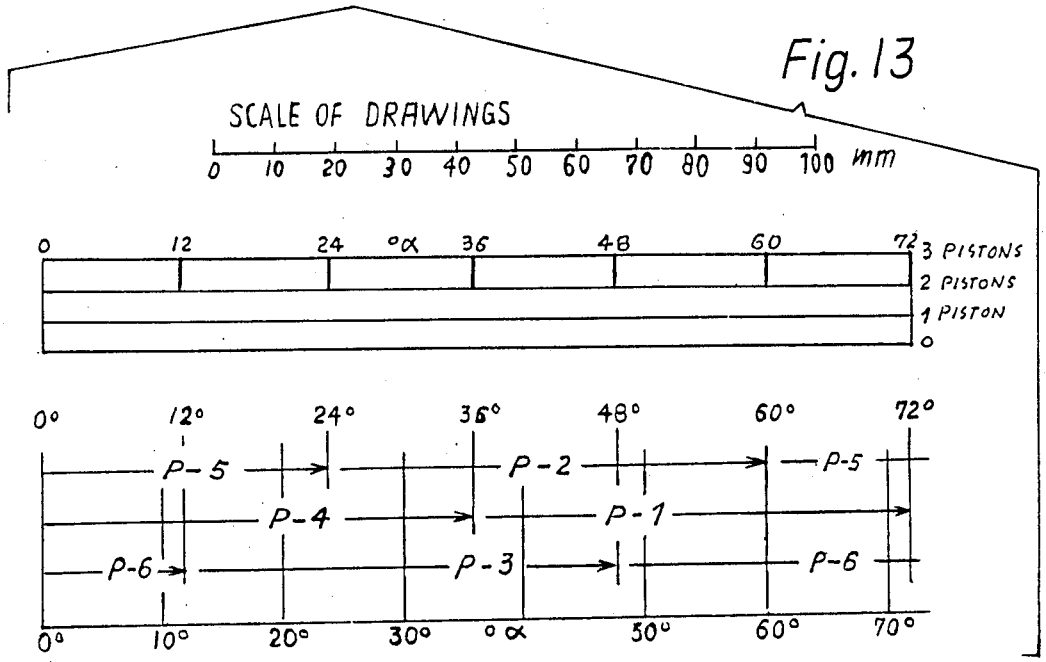

FIG. 13 is a schematic to explain actions of FIG. 12.

FIG. 14 is a longitudinal sectional view through a further embodiment.

FIG. 15 is a sectional view through FIG. 14 along line XV—XV.

Figure 16:
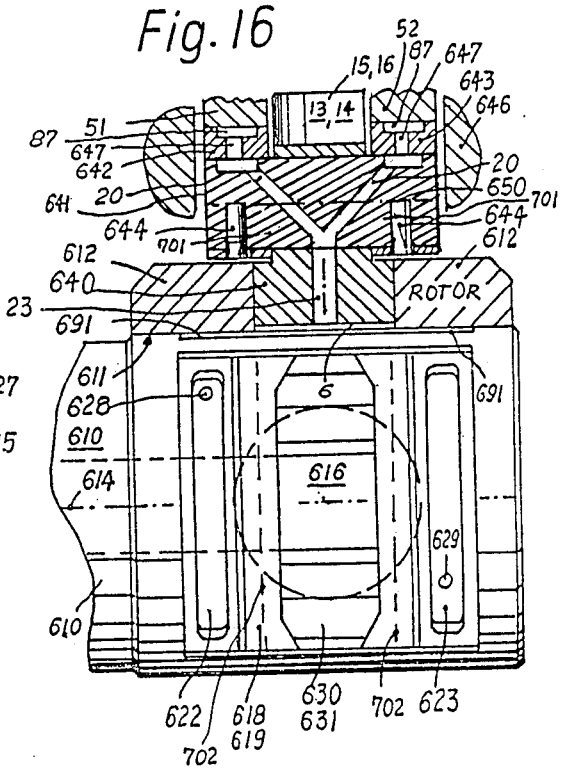

FIG. 16 demonstrates another embodiment of the invention.

Figure 17:
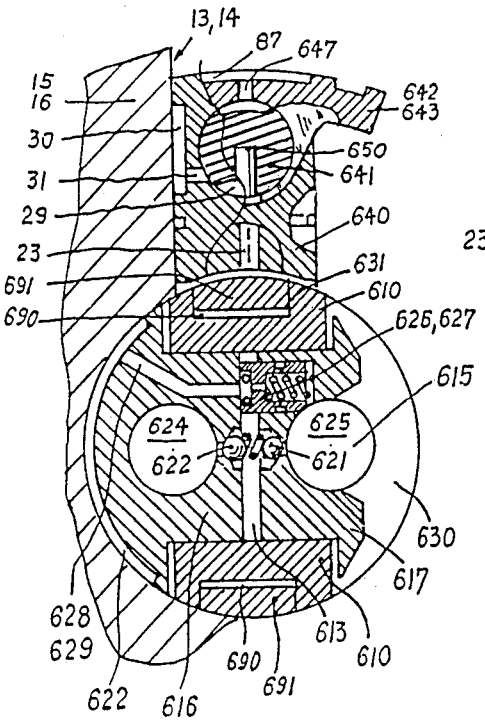

FIG. 17 is a sectional view through FIG. 16 along line XVII—XVII.

Figure 18:
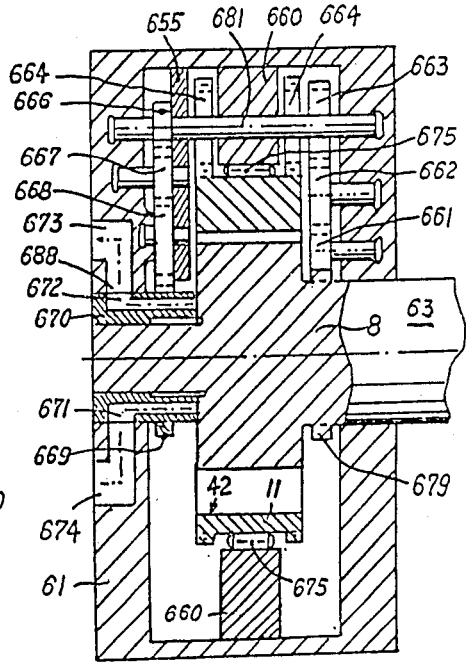

FIG. 18 is a longitudinal sectional view through another embodiment.

Figure 19:
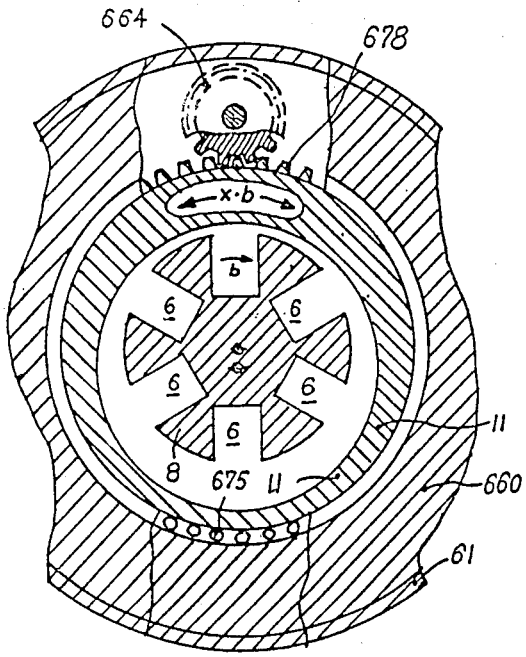

FIG. 19 is a sectional view through FIG. 18 along line XIX—XIX.

FIG. 20 is a partial section through a further embodiment,

FIG. 21 is a sectional view through FIG. 20 along line XXI—XXI.

Figure 22:
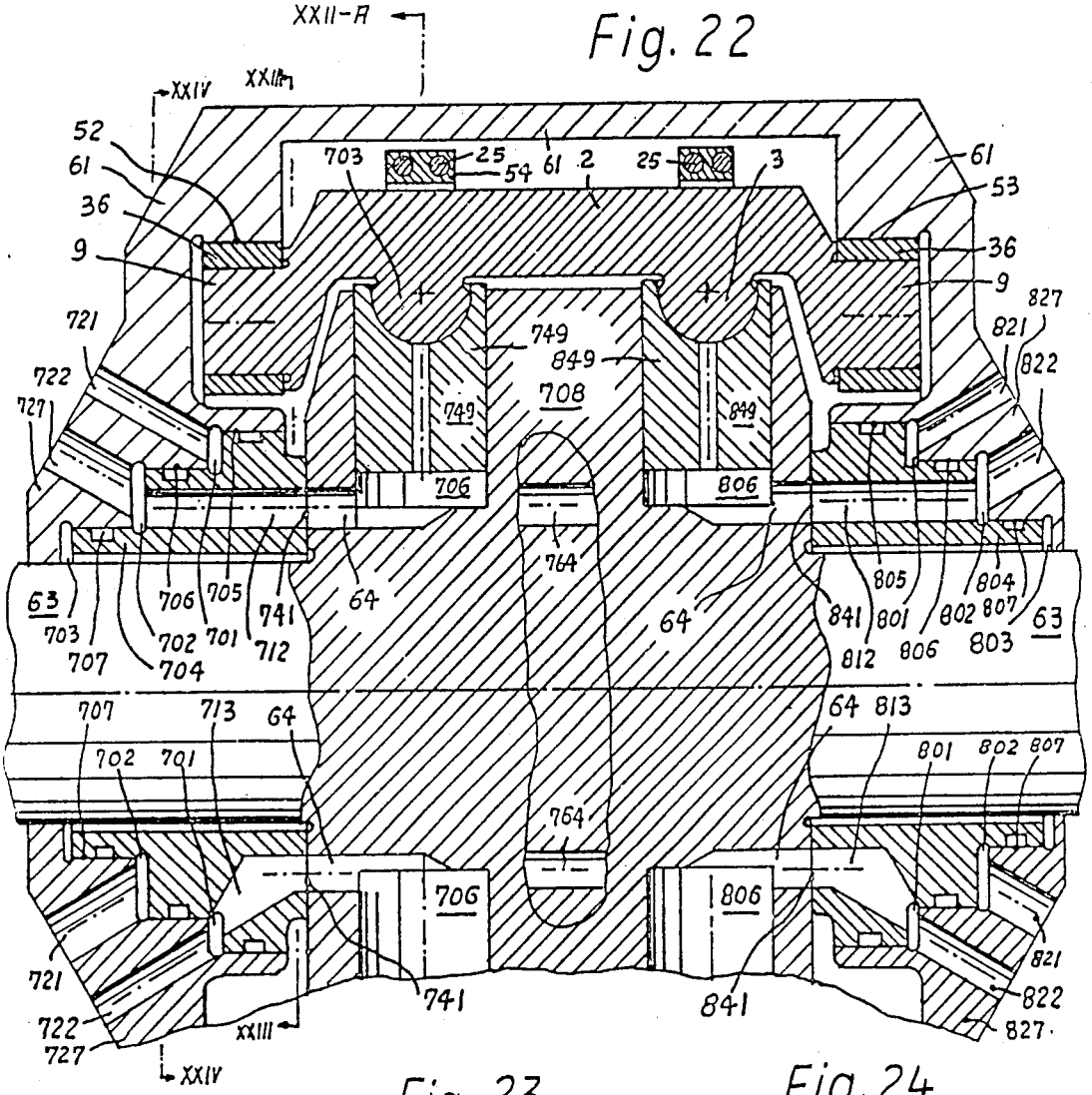

FIG. 22 is a longitudinal sectional through an other embodiment.

Figure 23:
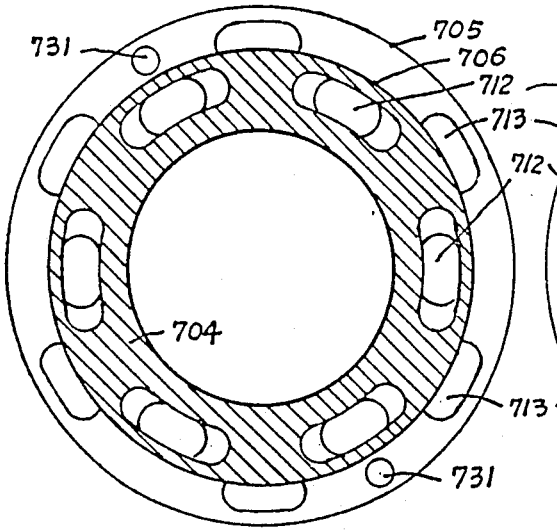
Figure 24:
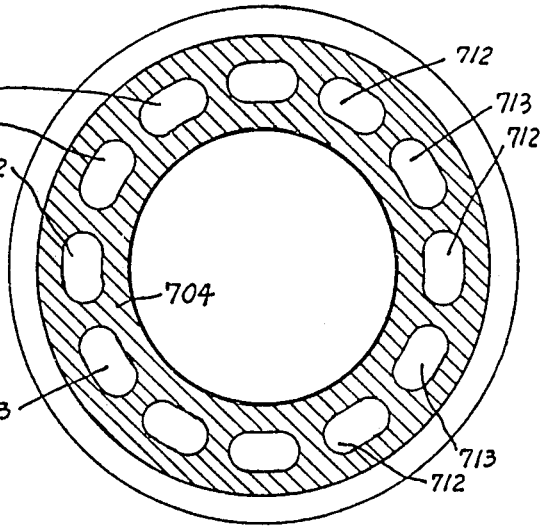
Figure 25:
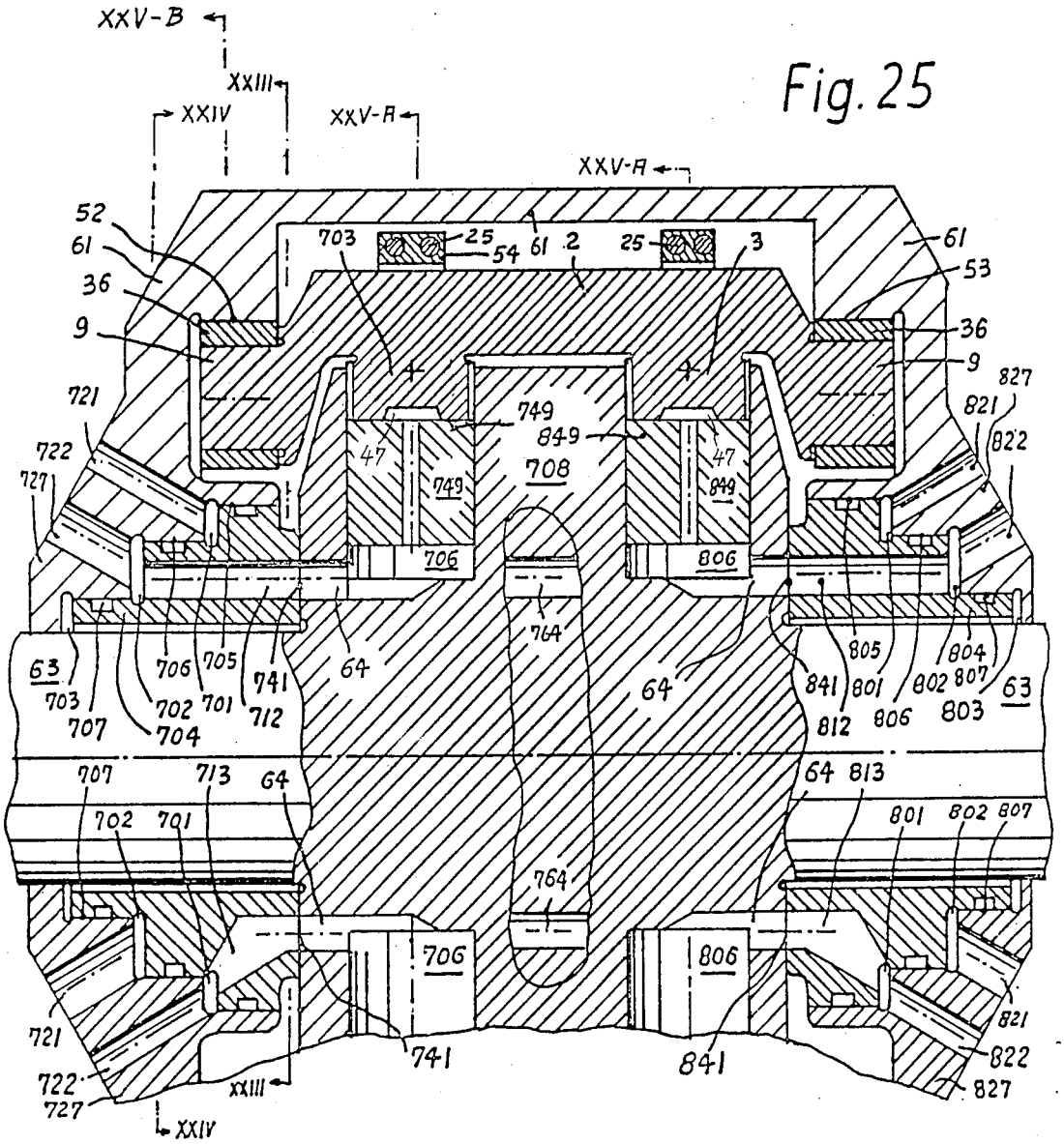

FIG. 23 is a cross-sectional view through FIG. 22 along XXIII—XXIII;

FIG. 24 is a cross-sectional view through FIG. 22 along the line XXIV—XXIV; and;

FIG. 25 is longitudinal sectional view through another embodiment of the invention.

FIGS. 22A and 22B are sectional views through portions of FIG. 22 along the arrowed line XVIIA of FIG. 22.

FIGS. 25A and 25B are cross sectional views through portions of

FIG. 25 along the arrowed lines XXVA and XXVB, respectively.

Figure 26:
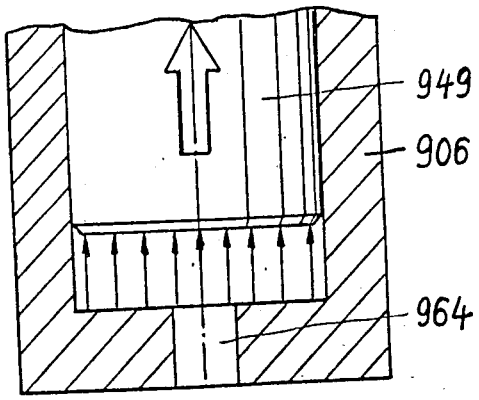

FIG. 26 is a sectional view through a portion of a cylinder.

Figure 27:
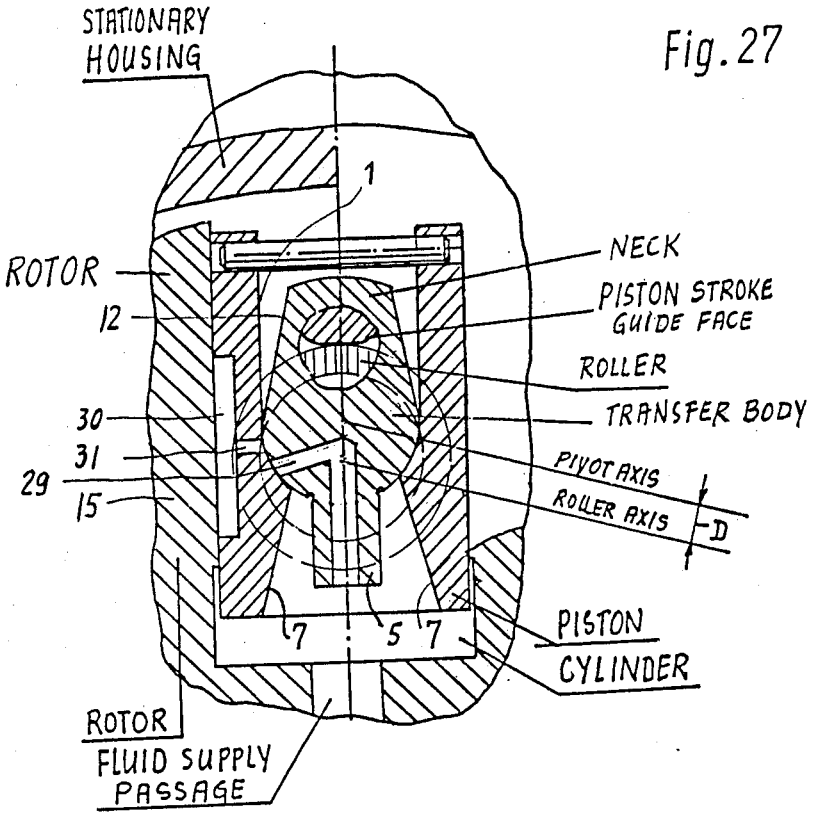

FIG. 27 is a sectional view through a portion of the invention.

FIG. 28 corresponds to FIG. 27, however, with an inclined member.

FIG. 29 shows a schematic explanation.

Figure 30:
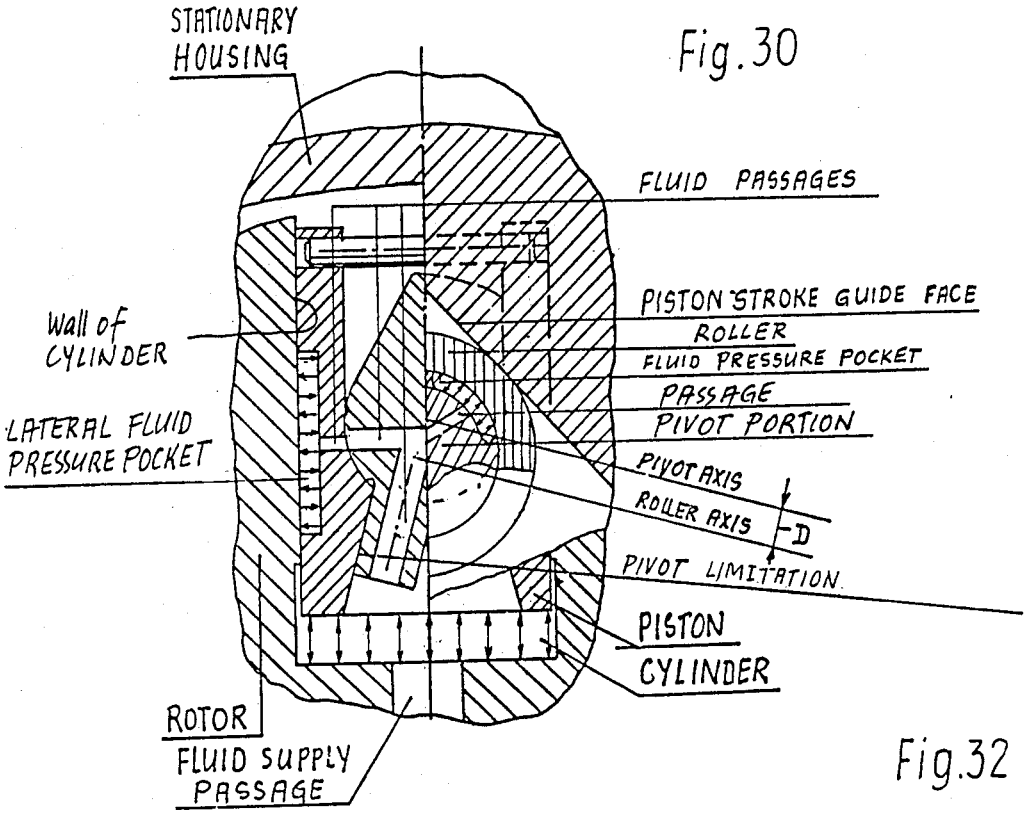
Figure 32:
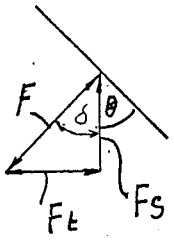
Figure 31:
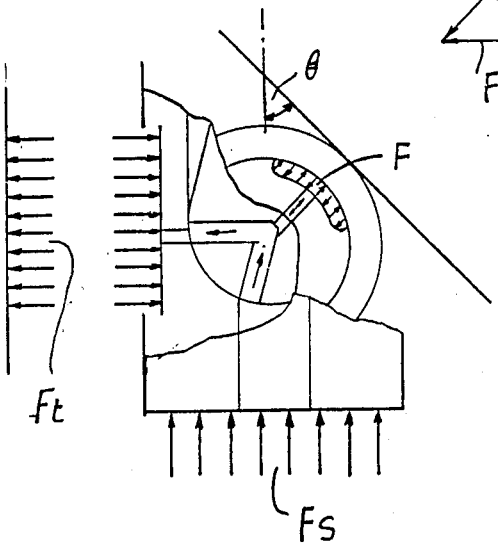

FIG. 30 is a combination of FIG. 28 with an explanation.

and FIGS. 31 and 32 show geometric-mathematic schematics.

FIG. portion 2A is the section taken through portion 2B along the arrow therein, while portion 2B shows partially the section along arrow V and partially along arrow W of portion 2A. FIG. portion 3A is the longitudinal section, corresponding to arrowed line Y of portion 3B, while portion 3B shows the section along arrowed line X through portion 3A and portion 3C shows the section along the arrowed line Z of portion 3A. Accordingly portion 4A is the longitudinal sectional view, 4B is the section along B—B of portion 4A, 4C is the view along arrow E of 4B; 4D is the section along D—D of 4B and 4E is the section along A—A of FIG. portion 4B. FIG. portion 5A is again the longitudinal sectional view, while 5B is the section along F—F of 5A, 5C is the view onto 5A from arrow H, 5D the view onto 5C from arrow: K and FIG. portion 5E demonstrates an alternative thereof.

DESCRIPTION OF THE PREFERRED EMBODIMENTS

In FIG. 1 the former art is described by way of example. Rotor 108 has cylinders 106 wherein pistons 105 are reciprocable. The pistons 105 carry a bar 107 which has on its ends rollers 104 which roll along the outward and inward inclined guide faces 102 and 103 of the stroke guide 101.

The characteristic of this former art is, that the piston 105 extends out of the cylinder 106 and out of rotor 108 and has its bar and rollers 104 and 107 radially outward of the cylinder 106 and of rotor 108. When the rollers 104 roll along the guide faces 102 or 103, the piston is either moved inward or moves outward in cylinder 106 and rotor 108, but under the inclination of the guide faces 102 or 103 a lateral or tangential component of force appears on the outer portion of the piston 105 which carries the rollers 104. This tangential force appears radially outward of the cylinders 106 and tends to tilt the piston 105 in the direction of the arrows A or B depending on which face 102 or 103 the rollers 104 are sliding at the respective time. The tendency to tilt the piston and the lack of lubrication between the piston and the cylinder wall provide together with the outer location of the power transfer center in the center line of bar 107 radially outward of the cylinder 106 the limitations of the former art which are specified in the prior part of this application.

In the summary of the invention, A describes FIGS. 2 to 13. B describes specifics of FIGS. 2 to 5 which are also partially present in FIGS. 6 to 12. C describes specifics of FIGS. 2,5, and these are partially present in FIGS. 6 to 12. E to G describe further details of these Figures. H describes the specifics of FIGS. 3 and 2. I describes FIGS. 20 and 21. K describes the specifics of FIGS. 2, 4 and 5, which are partially also present in other Figures. L,M,N,O and P, describe very detailed arrangements of FIGS. 2 to 5 which ar partially present also in other Figures. Q describes the specifics of FIGS. 14 and 15. R describes a feature of FIGS. 10 and 11. S describes another feature of FIGS. 10,11 and-or others. T describes features of FIGS. 8 to 11. U,V,W and X describe major features of the invention which are present in FIGS. 2 to 15, or which are provided by these Figures. Y defines a requirement for large piston strokes, which is utilized in or by FIGS. 2 to 21. Z includes in its description the means of FIGS. 2,5 and others. Z1 describes the embodiment of FIGS. 8 and 9. Z2 describes details of FIG. 14. Z3 describes FIGS. 18 and 19. Z4 describes portions of FIGS. 16 and 17 and so does Z5. And, Z6 describes another portion of FIGS. 16 and 17.

In the embodiment of FIG. 2, wherein the left portion of the Figure is a longitudinal sectional view through a portion of a multi-stroke device and the right portion of the Figure is a cross-sectional view therethrough along the arrow, the rotor 8 has working chambers or cylinders 6.

Pistons 49 are provided in working chambers or cylinders 6 and able to reciprocate therein. Stroke guide 11 with end portions 52,53 is mounted in the housing and has outward and inward guide faces 42 and 43. The stroke transfer body 2 is provided between the pistons 49 and the guide faces 43,44 of the stroke guide 11. The stroke guide 11 is mounted radially of the cylinders or chambers 6, pistons 49 and rotor 8. The arrangement also has inlet and outlet channels and flow control means to control and pass fluid into and out of chambers 6. The guide faces 43,44 form multiple inward and outward faces. So far, the figure corresponds to the former art and the known former art may be defined, as in "A" of the summary of the invention, as follows:

"In a radial piston device in combination: a housing, a rotor rotatably mounted in said housing, working chambers in said rotor, pistons reciprocable in said working chambers and along wall faces of said working chambers, inlet channels and oulet channels communicated to said chambers and to said housing, a stroke guide provided in said housing and radially of said chambers and pistons for the guidance of the strokes of said pistons, stroke transfer bodies mounted between said pistons and said stroke guide, control means for the control of flow of fluid to and from said working chambers, and multiple inward and outward guide faces on said stroke guide to guide said reciprocable pistons a plurality of times inward and outward in said chambers along said wall faces at each revolution when said rotor revolves."

The invention differs in its basic part from the former art thereby, that it uses a device of the former art, but, a device of the former art, "wherein fluid pressure pockets are provided in the direction of a lateral load of said piston, wherein said fluid pressure pockets are located on peripherial outer portions of said pistons and on portions of said wall faces, wherein control portions are provided to control the flow of fluid into said pockets, and, wherein said control portions are acting in timed relation to the move of said stroke transfer bodies along said outward and inward guide faces of said stroke guide."

Pockets 30 are the mentioned fluid pressure pockets of the invention; the referentials 10,26 show the peripherial outer portions of the pistons 49 and referentials 13,14 show the portions of the wall faces whereon the fluid pressure pockets 30 are located. Referentials 31, 22,3 show the control portions for the control of flow of fluid into pockets 30 and the acting in timed relation to the move of the stroke transfer bodies is a portion of the basic part of the invention, but to materialize this portion of the invention, several solutions may be applied, whereof FIG. 2 demonstrates one of the several possible solutions thereof.

For a further understanding of the Figures of the invention FIG. 2 should now be studied together with FIGS. 3 and 4 and 5 which show specifics which are applied in FIG. 2 and which are basically also applied in a great number of the other Figures The details are of such sophisticated nature, that they will be better understood when FIGS. 2 to 5 are studied together, because FIG. 2 would become too overcrowded, when all details would be cited by referential numbers therein. Since the details of FIG. 2 are described in great detail at the description of FIGS. 3 to 5, the description in other Figures wherein the means of FIG. 2 are employed will not be repeated in the description of such other Figures, like the description of FIGS. 12 to 15 or 22 to 25.

Referring first to the rotor 8 demonstrated in FIG. 3 in sections X,Y and Z, the working chamber 6 may be a radially extending cylinder 6 and be bo rdered by its walls which form wall faces 13 and 14. The wall faces 13 and 14 which are also a single wall face, extend radially outward to the outer diameter 117 of the rotor 8.

The rotor 8 is however provided with radial extensions 15,16, which are interrupted by the radial outer extension of the cylinders 6 and thereby form radial segments as the mentioned radial extensions 15 and 16. To understand this better, it may be assumed, that the rotor is first machined with a bigger diameter 115 and thereafter endwards of the medial radial extensions 15 and 16 the outer ends are cut off by cut offs 17 on both axial ends of the radial extensions 15 and 16, as seen in the left part of FIG. 3. Before the cut offs 17 are done, however, the chambers or cylinders 6 are machined into the rotor from the outer diameter 115 to the bottom 116 of the respective cylinder 6. At this time of machining also the walls of the chambers 6 are accurately smoothed and dimensioned, in order that they form proper wall faces 13,14, which at this time are still a single cylindrical wall face 13. When however thereafter the cut-offs 17 are cut, the outer portion of the rotor divides into the sections or segments 15 and 16 of the radial extension and the wall face 13 of the cylinder then forms extended wall face portions 13 and 14 along the radial extensions or segments 15 and 16. These wall face portions 13 and 14 are very important matters of the invention and they will become at action of the device also the guide faces, whereat the pistons are mainly held and guided and they thereby form in actual action the piston's guide and support-faces and torque- and power-reception faces.

The rotor 8 may further obtain outcuts 18 on both ends in order to be able to receive therein later during action of the device portions of the stroke transfer bodies or of means, which are associated to the stroke transfer bodies. The medial radial extensions or segments 15,16 may obtain axial end faces 19, which later in action may guide guide means of the stroke transfer bodies or just permit together with the outcuts or end-cut offs 17 the entrance of the medial extensions 15,16 into a room, space, recess or outcut between end portions of the stroke guide 11, when assembled in the housing. Such rooms, recesses or like are shown in the left portion of FIG. 2 by referential 27 and are located between the end-portions 52 and 53 of stroke guide 11.

Referring now to the details of the piston, which is demonstrated in detail in FIG. 4, the piston 49 forms a bearing bed 45 for the reception and bearing of the bearing face of the respective stroke transfer body. The bearing bed forms a face 45 of an equal radius, substantially equal to a respective radius of the bearing face of the stroke transfer body and around a center equal to that of the respective portion of the respective stroke transfer body. The piston 49 is provided with radial extensions 26. In the Figures, where equal parts appear on two sides or the like, the other equal parts may be cited by a pre-digital 1 in order to show, that there are two of these parts, but in the description the pre-diget 1 will be left out. Radial extensions 26 form pivot-limitation faces 1 on the inside of the radial extensions 26. These pivot-action limitation faces are very important, because it will be seen later, that without them and without the radial extensions 26 of the pistons 49 there is not much hope to materialize the aim of the invention, namely to increase the power, efficiency and torque of the multi stroke devices very decisively. Slight improvements of technologies may be possible by the selection of good materials, good machining accuracies and good designs. But decisive improvements are possible only by the application of proper means of an invention and the here mentioned details of the rotor, pistons and stroke transfer bodies are extremely important parts of the invention for the obtainment of the decisive improvement.

On the radial outer or upper portion of the radial extensions 26 retainers 25 may be provided to retain the respective stroke transfer body in the piston and to prevent an escape of the stroke transfer body from the piston. In certain cases of application it is also suitable to set a distance keeper and holder 54 between the radial extensions 26 and fasten thereby and with the help of retainers 25 and radial extensions into fixed parallelity and rigidity relatively to each other to prevent any deformation of them.

The outer diameter of the piston 49 is shown by the outer face 10 which extends over the entire length of the piston and thereby also over the radial extensions 26 where the face 10 forms the outer face portions 10. The peripherial outer portions of the piston 49 are those which are close to the outer face 10. They are shown by referential 110. They are mentioned here to make it clear, where the fluid pressure pockets are located.

The fluid pressure pockets 30 are, when they are provided on the piston and not on the cylinder wall, cut through the outer face 10 into the peripherial outer portion 110 of the piston 49 at such place, where the later to be discussed lateral load or tangential load of the piston will appear. The said lateral load acts in the left portion 4B of FIG. 4 from right to left or from left to right depending on the angle of pivotion of the stroke transfer body in bearing bed 45. In the Figure, the bearing bed 45 is a half of a hollow cylinder configuration and the respective portion of the stroke transfer body of FIG. 5 has a complementary formed bearing face 46, whereby it is assured, that the piston 49 can not revolve relatively to the stroke transfer body. It would however also be possible, to use part-ball formed bearing beds 45 and bearing faces 46, but then it would be required to set other means to prevent rotation of piston 49 relatively to the stroke transfer body 3. That could then for example be the embracement of extension-side faces 55 by inner faces 50 and 51 of the guide portions 39 and 40 of stroke transfer body 3.

The passages 31 are cut from the bearing bed 45 to the respective fluid pressure pockets 30. They must be accurately placed, because they form important means of the control of flow of fluid into the fluid pressure pockets 30 in timed relation to the stroke transfer body and the guide faces of the stroke guide. The passages 31 thereby form the second passages of "O" of the summary of the invention. The piston also forms first passages 23 which form the first passages of "O" of the summary of the invention. The recesses 47 form correspondingly the flow control recesses 47 of "O" of the summary of the invention. The flow control recesses 47 must connect and communicate the first passages 23 and the second passages 31 at all power strokes of the pistons but it must also cut-off or discommunicate the first and second passages 23 and 31 at opposite, reciprocal or non-power strokes of the pistons. For these reasons the accuracy of setting of the recesses 47 and of the second passages 31 is required. The function of the flow control recesses 47 can also be taken over by the flow control recess bores 29 of "F" of FIG. 5.

It should be noted, that the pockets 30 extend radially outwardly wide in the radial extensions or portions 26 of the pistons.

The pistons may also form inclined pivot-limitation faces 7,117 on the first passages 23 or other portions in the bottom portion of the respective pistons 49.

Reference is now made to the very important stroke transfer body of FIG. 5. The portions of the Figure show sections or views as indicated by the arrows and capital letters.

The stroke transfer body has as one of its main portions the bearing portion 3 of "F" of the summary of the invention with thereon the bearing face 46 of "E" of the summary of the invention. They are to be borne in the bearing bed 45 of the piston and they are able to pivot in said bed, whereby the said bearing faces 46 slide along the face of the bearing bed 45 of the piston. Fluid pressure pockets or recesses 47 may be cut into the bearing portion 3 in order to carry a portion of the radial load of the piston and stroke transfer body and in order to lubricate the mentioned bearing bed and bearing face 45 and 46. The recesses 47 are correspondingly communicated at all times to the first passage 23 of the piston and thereby to the pressure in fluid in the respective working chamber 6.

Other main portions of the transfer body 2 are the radially extending necks 222 of "K" of the summary of the invention, which extend radially outwardly from the bearing portion 3 of the transfer body, and the end portions 9, which form the ends of "C" of the summary of the invention.

The ends or end portions 9 extend laterally from the medial or bearing portion 3 and are preferred to extend around a second axis 38 which is an eccentric axis relatively to concentric axis, hereafter called "center axis" 4 of the bearing bed 45 of piston 45 and of bearing portion 3 of the transfer body.

A radially inward directed eccentricity 37 is provided between the centric axis 4 and the eccentric axes 38. This is important, because without it the aim of the invention of transfer body of FIG. 5 can not be easily obtained. The ends 9 may be cylindrical bars around the eccentric axes 38. Axis portions 38 are provided on the same axis 38 but do not appear in the medial or bearing portion 3, but only in the end portions 9. The end-bars 9 may have cylindrical outer faces to be able to carry members of "C" of the summary of the invention thereon. The said members may be rollers or rings 36 of FIG. 2. Theoretically it is possible and in practice it is also possible to set roller or ball bearings instead of rings 36 of FIG. 2 onto the cylindrical outer faces of ends 9. However, such ball- or roller-bearings have only limited load capacity and are not very strong to obtain a maximum of transfer of load or forces. The rings of FIG. 2 in combination with the stroke transfer body of FIG. 5 are capable of carrying a higher load and they are more reliable in practical operation than ball-bearings or roller bearings would be. Because the ball- or roller-bearings might break quickly under over-load.

In order to obtain a smooth running without wearing and with small friction of the rings or members 36 of FIG. 2 along the outer faces 56 of ends 9, the fluid pressure pockets 35 of "B2" of the summary of the invention. The pockets 35 receive fluid under pressure by passages 20,22 and 23 from the respective chamber 6. The passages 20 and 22 are visible in G of FIG. 5. They are also visible in H of FIG. 5 and their location is further visible in the right portion of FIG. 2. The pockets 35 are commonly radially outward directed in ends 9, but when a device is supposed to revolve in one single direction, it is suitable to displace them angularly in a direction normal to the respective stroke guide faces 42 or 43 respectively. In devices for both rotary direction such displacement is not easily to be done. The direction of the pockets 35 to be normal to the inclination of the respective guide face 42 or 43 is generally desired and even required for an almost perfect operation. But for double directional devices, the desired complete perfection can not yet be easily fully obtained. It is however partially obtained and assisted additionally by the pivotion of transfer body 2 in the piston, which will be later discussed. This pivotion turns the neutrally radially outward direction of the pockets 35 in a direction towards the normal direction to the inclination of the guide face 42 or 43. How far this turning in this direction by said pivotion is done, is a question of the actual design and depends on the angle of the faces 1 and 12 of piston and transfer body 2. It is illustrated in the right portion of FIG. 2, namely in FIG. 2A.

The bearing portion 3 contains further the flow control recesses or flow control bores 29 and/or 47.

The transfer body may further be provided with guide portions 39 and 40 which may have guide faces 44 and 41 outwards and guide faces 50 and 51 inwards for the purpose of guiding the piston extensions 26 with their end faces 55 on the inner faces 50 and 51 to prevent rotation of the piston relatively to the transfer body or to guide by the outer faces 41–44 along portions of the housing or portions of the stroke guide 11 or to guide the transfer body by the inner faces 50 and 51 of the guide portions 39 and 40 along the end faces 19 of the extensions 15 and 16 of the rotor 8 in order to prevent dislocation of the axis 4 and of axes 38 from parallelity to the axis of the rotor 8 and of stroke guide 11. Because a misalignment of the direction of axes 4 and 38 might disturb the device and the part-cylindrical beds would function improperly when such adverse direction of axes 4 and 38 would occur.

The neck 222 is provided with pivot-action limitation faces 12,112 whereby the neck becomes a pivot-angle limitation means or an excessive pivotion stopper or preventer. At the same time however, the neck 222 is a radial stabilizer, because it strengthens the radial bearing capacity of the therebelow present bearing portion 3 in radial direction and thereby prevents radial deformation of the ends 9. It thereby increases the radial pressure capability of the transfer body.

As seen in F of FIG. 5, the limitation faces 12 are inclined relatively to each other to make the neck 222 narrower radially outwardly. This is required to permit the bearing portion 3 and neck 222 to pivot in the bed 45 and in piston 49.

It is important to note, that the angle of inclination of the limitation faces defines the maximum of the angle of pivotion of the transfer body. At the said maximum angle of pivotion one of the limitation faces 12 or 112 bears and seats on the respective limitation face 1 of the radial extension 26,126 of the piston 49. Instead of providing the pivot angle limitation by the neck 222 it is also possible to provide a radially inwardly extending neck 5 of portion 3 into the passage or recess 23 in the bottom portion of the piston 49 as shown by inner neck 5 in FIG. 2. Inner neck 5 then bears on limitation face 7 and thereby limits the angle of pivotion. Depending on the actual situation either the outer neck 222 or the inner neck 5 is provided, or both of them are provided to act in unison.

An other important matter is the downwardly or radially inwardly directed distance or eccentricity 37 bewteen the centric axis 4 and the eccentric axes 38. Axis 4 will be a point, when ball-part formed beds and bearing faces are provided, but the distance 37 in the mentioned direction will be the same as in the present Figures.

This eccentricity 37 is required for the purpose of actuating a pivotal movement of the transfer body. Because without a pivotal movement the first and second passages 23 and 31 can not communicate and discommunicate. The control recess 29 or 47 would then be stationary and could not control the flow of fluid.

Since there is the eccentricity 37 in the invention, the radial outwards directed force out of fluid in pressure in chamber 6 graspes the transfer body in the medial center 4. But the resisting or acting forces of the guide faces 42,43 of the stroke guide act on the transfer body more radially inwardly, namely on the centers 38. Thereby, as soon as the transfer body moves along an inclined guide face 42 or 43 and pressure is present in chamber 6, the inclination of the faces 42,43 moves the axis 38 laterally or tangentially in the piston 49 and thereby pivots transfer body 2 around the concentric center axis 4 until the limitation faces 12,1 or 5,7 meet and stop and prevent a further increase of the angle of pivotion.

Between the outward and inward inclined guide faces 42,43 of the stroke guide 11, there are meeting points, faces or areas between meeting faces 42 and 43. These are the turning or neutral areas. As soon as the transfer body or its member 36 has moved over such turning area it meets a respective inclined guide face 42 or 43. When then pressure is present in chamber 6, the pressure forces the piston 49 radially outward against the inclined guide face 42 or 43. The inclination of the guide faces 42 or 43 immediately divide the force of the piston 49 into two forces of components of forces, namely one in radial direction and the other in lateral or tangential direction, which is the direction normal to the radial direction of the radially directed force on the piston's bottom. The bearing portion 3 can not move laterally in piston 49 because it is stably borne in the bearing bed 45. Since however, the distance 37 or eccentricity 37 is present between the center 4 and the axes of the ends 9, the ends 9 can swing in the direction of the arrow 60 in FIG. 7 or in the contrary direction or in the direction of angle 24 of FIG. 2, right portion of the Figure, or in the contrary or opposite direction. This swing or pivotion is a displacement substantially in the lateral direction of the lateral component of forces of the eccentric axis 38 and thereby of the end members or ends or end parts 9. The displacement of them in the said lateral direction under the force of the lateral component of forces in 58 in FIG. 7 or the lateral distance of axis 38 in the right portion of FIG. 2 from the center line 59 of piston 49. The lateral displacement 58 is in practice the pivotion of the transfer body into its maximal angle 24 of pivotion at which the stopper or limitation faces 1 and 12 or 5 and 7 meet and stop on each other.

How the pivotion is actuated and stopped at the maximaum angle gamma or 24 is now understood and attention is now requested to the right portion of FIG. 2. Therein on the left part is shown in section along the line W—W but the right portion is shown along the sectional line V—V of the left Figure of FIG. 2. Thereby in the right side the inclined guide face 42,43 is directly visible and visible is there also the engagement and rolling of member 36 along the inclined guide face 42,43. The tangential or lateral force component 33 is now almost or directly in the center line 4 and the fluid pressure pocket 30 in the left side is practically symmetrically laid around the center line or axis 4. Thereby the component of forces, which is the lateral component 33 of forces acts on the arm 34 of moment 33×34 and supplies a torque 33×34 into the pressure pocket 30 and thereby by pressure in fluid directly in the centre line 4 against the wall face 13 or 14. Thus, the torque is not transferred any more by mechanical touch of the piston onto the wall of the cylinder, but in its major portion transferred by the pressure of the fluid column 32 in fluid pressure pocket 30. Such actuation of torque onto a rotor is an action under the lowest possible friction and therefore a most effective means to transfer a torque from a piston onto the rotor 8, namely the aim and object of the invention. The mechanical friction of transfer of torque or force by mechanical means is thereby prevented or drastically reduced by this invention. This would however not have been possible without the control means to control the flow of fluid into the pocket 30. The running of the rollers 36 along the inclined guide faces 43,44 provides a torque onto the pistons 49, but the fluid in pockets 30 transfers the torque of the pistons, which the pistons obtained from the mentioned guide faces 43,44, to the walls of the cylinders 6 and thereby onto the rotor 8 of the device.

It might also be noted from the right portion of FIG. 2, that the piston extends radially inward and outward practically equally long from the center 4. Thus, the piston 49 of the invention is not attached any more to the tilting tendency of arrows A or B of FIG. 1 of the former art, because the action of force does not take place any more outwardly and distant from the guide of the piston but practically directly in the middle of the piston and in the middle of the guidance of the outer face 10 of piston 49 along the guiding wall face 13,14 of the radial extension 15,26 of the rotor 8. Thus, any former tilting tendency, which the pistons were subjected to in the former art, is prevented by the means and arrangements of the invention. The bearing faces 46 are at rest on the bearing beds 45 of the pistons, once they have pivoted and that resting is maintained over the most of the length of the respective power stroke. Consequently there is practically no friction between bearing faces 46 and bearing beds 45 during the power strokes, when the small friction during the short times of pivotion is neglected.

The radial fluid pressure pockets 35 on the ends 9 are capable to carry a very high load. The arrangement of the invention of the Figures is therefore capable of very high pressures in fluid, for example of a couple of hundreds of atmospheres or quite a number of thousands of psi.

FIGS. 6 and 7 demonstrate the arrangement of the means of FIGS. 2 to 5 in a complete device. In this case the one-directional type is demonstrated, which shows a slight difference of inclination and location of the inclined guide faces 42 and 43. The pockets 35 are slightly angularly turned as suitable for one directional rotation as earlier explained. The multiplicity of the guide faces 42,43 is clearly visible and the space or recess between the end portions 53,52 of stroke guide 11 is obtained by mounting just end portions 52 and 53 into the housing 61. The Figures show the parts which were discussed.

FIG. 7 is a sectional view through FIG. 6 along the radial medial face 66. FIG. 7 demonstrates also the very large piston strokes, the angle of rotation and by arrows whether the pistons at the respective location move inward or outward. The Figures demonstrate a device with 6 chambers and pistons and nine strokes inwardly and outwardly of each piston at each revolution. There are consequently nine inward guide faces and nine outward guide faces 42,43. As far as numerals are appearing which have not yet been discussed, they are commonly known or applicable matters, such as for example holders 62 to fasten the stroke guide end portions 52,53 on the housing 61 or to fasten the stroke guide 11; or a shaft 63 in the rotor 8 or channels 64 to pass fluid from ports 65 to chambers 6 and vice versa.

The pressure in the fluid in the cylinders 6 acts onto the bottoms of pistons 39 and passes through the passages 23 and 20 into the pockets 35 in the transfer bodies below the rollers 36. The pressure in the fluid passes also into pockets 30 in the pistons 39 at times when the rollers 36 roll along the inclined guide faces 43,44, at which times the transfer bodies are pivoted in the pistons 39 to open the passages 29,22 of FIG. 2 to passages 31 of FIG. 2 towards the mentioned pockets 30 in the pistons 39. Thereby the pressure in the fluid acts from the pockets 30 against the pistons 39 and against the wall face portions of the cylinders. Pressure in fluid acts also from the pockets 35 in the transfer bodies against the insides of the rollers 36 and against the respective portions of the transfer bodies 2,3. The resultant (sum) of forces of pressure in fluid from below the piston (out of cylinders 6) and from the pockets 30 in the pistons 39 is directed normal to the inclined guide faces 43 or 44, whereby the pistons with their transfer bodies float between the mentioned forces of pressure in fluid.

At the actual size of the Figure the 24 mm diameter pistons give power strokes about 15 mm in the device of an outer diameter of 160 mm and a weight of less than 40 lbs. At 300 atmospheres, that gives a theoretical torque of $24^2$ pi/4=452 mm square=4.52 cm square×300 Kg=1.357 Kg×3 pistons in power stroke=4.071 Kg×0.062 meter arm of torque=252 kilogram meter multiplied by the rate of lateral component. The lateral or tangential component is defined by the inclination of the guide face 42,43 at the power stroke and is the calculated radial force multiplied by the tangent of angle of inclination beta as shown in FIG. 7. At an angle beta of 30 degrees as about in the FIG. 7, the torque now becomes 252×0.57=about 145 kilogrammmeter multiplied by losses of torque by mechanical friction, which are relatively small. They are between 4 and 12 percent, depending on speed of rotation. At low revolution the mechanical efficiency may be calculated to be about 95 percent, giving 5 percent loss from the above calculated sample of torque. That is about 138 Kgm and indeed a very high torque for such a small diameter motor. The rotor 8 and the shaft 63 have to be of strong material to be able to handle the high torque which the small device produces. It should be noted here, that the calculated force of 4071 Kg acts on only three pistons and that multiplied by the tangent 0.57 gives 2348 Kg divided by 3=about 780 Kg tangential force per piston. It will be easily understood that such small pistons could not carry this high load on the wall faces of the cylinders, when the former art of FIG. 1 would be applied instead of the means of the invention. The pistons of the former art would quickly stick and disturb the device with such load in such small size.

FIGS. 8 and 9 demonstrate another embodiment of the invention which illustrate at the same time two different means of the invention. FIG. 9 is a section along line K—K of FIG. 8.

First the embodiment illustrates another possibility of a different stroke transfer body, whereby the limitation faces 1 and 11 can be spared. The neck 2 has here axial extensions 78 which replace the ends 20 and the axial extensions 78 carry distanced from the middle in peripherial direction or in the direction of rotation two pairs of rollers 74. Each pair of rollers 74 has a forward roller and a rear roller on a forward holder 73 and on a rear ward holder 72 Since the load is now carried by four rollers instead of by only two rollers, the rollers may now be ball or roller bearings 74. This arrangement of the first embodiment in these two Figures eliminates the requirement of pivot-angle limitation, because the forward and rear rollers 74 define the angle of pivotion when they are running along the respective inward or outward guide faces 242 or 243 of the outer portions 251,252 of the stroke guide 211. The recesses and passages for flow control to pockets 30 can be the same as in the embodiments of the previous FIGS. 6 and 7 etc.

The second embodiment of the invention in FIGS. 8 and 9 is the provison of cylinders or chambers 70 spaced away from the medial center 71 of the rotor 68. These chambers 70 extend beyond the middle 71 deeply into the rotor 68 and almost to the opposite diametrical outer face 117 of the rotor. The pistons can thereby do a very long stroke, times longer than in the previous FIGS. 6 and 7. This is seen by pistons 75 and 85 whereof 75 has an innermost and piston 85 has an outermost location. Channels 69 are the channels for the transfer of fluid into and out of chambers 70. Bearings 76 carry the rotor 68 and a shaft seal 78 may be provided. Other details are known from the description of the other Figures or from my elder patents.

FIGS. 10 and 11 illustrate again two other embodiments of the invention. The chambers or cylinders are chambers 70 of FIGS. 8 and 9, which provide the extremely long piston stroke and which are defined thereby that their axes are laterally distanced from the center 71. The arrangement is in FIG. 11 a section along line X—XI of FIG. 10.

The first embodiment of the invention of these FIGS. 10 and 11 is, that there are a plurality of chamber groups provided in the rotor which are axially distanced from each other as defined in "R" of the summary of the invention.

The second embodiment of the invention, demonstrated in FIGS. 10 and 11 is, that common piston shoes of my elder or co-pending patent or patent applications can be used. The requirement of pivot-angle limitation stoppers is hereby also spared. That is obtained thereby, that the stroke guide has cylindrical inner faces which form the inclined inward and outward guide faces. In this case every piston group has only one inward and one outward stroke at the same revolution, because the multiples of strokes per revolution are obtained by the application of the multiple groups of chambers. The rotor 80 has correspondingly a plurality of radial extensions 415 or 416 and there must be a medial portion 511 with guide faces on the stroke guide arrangement. Since my elder patent-piston shoes can be used in these Figures, they can be utilized for self-suctioning of fluid. The device is insofar also suitable as a self-suctioning pump. The traction rings 81 with traction faces 82 are therefore provided, when so desired, to guide the piston shoes 83 outwards by embracing their end portions radially from the inside. Since the outer faces 84 of the piston shoes 83 define the angle of inclination or of pivotion, there is no reqiuirement for pivot-angle limitation faces or stoppers in this embodiment. The required arrangement of the fluid pressure pockets 30 and the control of flow of fluid to them can be applied as in the earlier FIGS. 2 to 7. The fluid pressure pockets 87 in the piston shoes are equal to those in my patents, for example as in my U.S. Pat. No. 3,951,047. Novel, however, is the axial shortness of the piston shoes and thereby another object of the invention. The piston shoe of this embodiment has the novel feature, that its axial length is about equal to the diameter of the piston whereto it is associated. Thereby the fluid pressure pockets 87 are led radially above the piston and any lateral deformation of the piston shoes lateral end portions is thereby prevented.

The plurality of chamber groups and piston groups, which are axially distanced from each other in rotor 80, are set with their axes through the radial faces 91 and 92. Channels 69 and 89 demonstrate samples for their location in the rotor and for their control and association to the ports 93,94,95,96. Since the chambers or cylinders extend almost through the rotor 80, the passages or channels are not, as usual in that half of the rotor where the pistons show out of the rotor, but on the diametrically opposite half of the rotor. This must be recognized when setting the controls for the flow of fluid to the chambers 70 and out thereof. Similar matters should be recognized when building the device of FIGS. 8 and 9.

The one chamber group may contain the pistons 85 and the other the pistons 86. The FIG. 10 also demonstrates by way of example radial flow control faces or axial flow control faces. For example, the rear end face of rotor 80 and the cylindrical faces 98. In the right portion of FIG. 11 the very long arm 99 of torque which is obtained by the arrangement of the very deep entering—long-stroke pistons 85,86 of FIGS. 8 to 11 and which forms with pressure pocket center 530 the torque-arm 99 multiplied by force 530 of the pocket 30.

The piston shoes 83 are guided on the guide faces 43. Passages 23,31, pockets 29,30, beds or faces 45,46, axes 4, holders 25,54, outer faces 84, piston portions 26, wall faces 13, and bearings 76 are similar in principle to those discussed with equal referential numbers in others of the Figures. Bearings 76 carry the rotor 80 in the housing 61 and piston stroke actutor- or guide-rings 551,511,552 are located in the housing 61 and form the guide faces 43 to guide thereon the outer faces 84 of the piston shoes 83.

The embodiment of FIG. 12 shows inclined outward and inward guide faces 43 and 44 of an angle of 45 degrees relative to the radial axis through the respective cylinder. There are five strokes per piston and revolution in this Figure. The rotor 8 of this Figure has six working chambers or cylinders 6. The pistons or chambers are cited by P-1 to P-6. The angle of rotation of the first cylinder 6 is defined by the angle between the vertical medial face through the device and the radial center line of the first chamber or piston 6,29, and named "alpha". The angle of inclination of the respective guide faces 43,44 is called "beta" and it is seen in FIG. 12, that a face of permanent inclination gamma of 45 degrees relatively to the radial center line through the cylinder and piston is not a straight 45 degree face, but actually a curve. The Figure illustrates also the component of the tangential or lateral force 601 which is at 45 degree angle beta the value 1 or equal to the radial force. When the angle beta would be still steeper, for example sixty degrees in this Figure, the lateral component of forces would exceed the ratio 1 and become at said degree for example 1.73. This shows, that the selection of the angle of inclination "beta" can even make the lateral component of forces larger than the radial component of forces. The force out of the fluid pressure pocket 30, which transfers the torque from the piston 49 onto the face of the wall of the respective cylinder 6 and thereby on the rotor 8, can then be bigger than the radial force below the bottom of the respective piston. It is seen here, that extremely high torque can be produced by the invention. The sizes of the pressure pockets 30 must be accordingly dimensioned. For beta sixty degrees the cross-sectional area through pockets 30 must be much bigger than for thirty degrees angle beta.

FIG. 12 also shows, that a very large piston stroke is obtainable by this Figure. It is in the Figure about 18 percent of the outer diameter of the device.

FIG. 13 shows which pistons act at what time in power-strokes, when the device is a motor, revolves clockwise in FIG. 12 and the outward faces 43 are thereby power stroke faces, but faces 44 are then inward or opposite or non-power stroke faces. The bottom diagram of FIG. 13 makes the timed control of flow to and from cylinders 6 over rotary angle alpha visible. The motor or device may have axial flow to the chambers, as in some of the previous Figures, but in FIG. 12 a radial flow through cylindrical control body 602 is shown. The outer face 603 of the control body is fitted into the inner face of the rotor 8 which forms the rotor hub and the rotor 8 revolves around the stationary control body 602. Narrow rotor passages or channels, such as f.e.: "a" of FIG. 15, extend from chambers 6 inwards through the rotor to and through the inner face 604 to slide along the entrance and exit ports. The entrance ports are cited by the referential "d" indicating flow delivery ports and the exit ports are cited by referential "e" indicating exit ports. Every outward stroke guide face 43 is radially of a delivery port "d" and every inward stroke guide face 44 is radially of an exit port "e". Thus, there must be as many delivery and exit ports as there are strokes of each piston per revolution of the rotor 8. The combination of 6 chambers with 5 strokes gives a very uniform torque, which is demonstrated in the upper diagram of FIG. 13. Care must be taken, that there does not appear dead-time at change from power- to non-power-strokes. This can be done by respective configuration of the corners between power- and non-power or inward and outward guide faces, or the moment of no-torque of one of the three pistons can be accepted, when the application permits it.

On top of the schematics or diagrams of FIG. 13 is a scale, which is valid for all of the Figures. Therefrom the actual measures can be obtained also when the drawing will be printed in the patent in a reduced scale.

The data of stroke = 18.5 percent of the outer diameter of the device together with the value piston diameter = 11 percent of the outer diameter gives a possibility to see immediately the maximum of torque obtainable in such 45 degrees motor, regardless of the outer size of the motor. Steeper inclinations of the guide faces with high angles beta give much higher torque but should be run only at lower rpm. When higher rpm are desired, the inclinations of the guide faces of the stroke guide should be kept softer.

FIGS. 14 and 15 demonstrate another embodiment of the invention, which does not require pivotion and pivot-limitation means of the transfer body.

This feature is obtained by setting the transfer of fluid and the control of flow of fluid to the pockets 30 not through the respective pistons but through the rotor. The application of thereby simplified transfer bodies 3 is very convenient. However the application of the flow and flow control through the rotor 8 to the pockets 30 in the pistons 29 requires an additional work and often even the insertion of bushes 471 into the rotor and fastening of them by holders 472 to the rotor 8 in order to provide the chambers or cylinders 6 in the bushes. The rotor channels or passages 605 of FIG. 12 are replaced by passages "a". In this embodiment a number of referentials are letters, because the figures do not provide enough space for the writing of large digits. Control body 602 passes fluid through entrance channel "D" and delivery ports "d" through the channels "a" into the chambers 6 and out thereof through passages or channels "a" and exit ports "e" through exit channel "E". The exits and deliveries reversed, when the device shall revolve in opposite direction or when it becomes changed from motor to pump or vice versa. The rotor or bush 8 or 471 has a pair of balance-fluid delivery passages 477 and 474 whereof one is in the rotary direction and the other in the opposite direction extending from the wall face 13 or 14. It may extend into collection chambers 473 or 478. In any case it communicates with a pair of balance-fluid delivery lines 475 and 476. One separated delivery line to each separated delivery passage 474 or 477. The delivery lines 475 and 476 port into balance fluid control ports 479 or 480 respectively. The control ports 479 or 480 may be provided on the control body 602 or on a cover or portion of the housing or of the device, depending on actual design and desire. In any case, since the delivery lines 475 and 476 revolve with the rotor 8, the control ports 479 and 480 are stationary in order that the lines run over them. When the ports 479 and 480 are laterally, axially or radially distanced from each other as shown in FIG. 14, where they are radially distanced, there can be applied a number of ports 479 equal to the number of strokes and a number of ports 480 also equal to the number of strokes and guide face sets 43,44. The ports 480 are then communicated to exit channel E and ports 479 to delivery channel D or vice versa.

Ports 479 extend over the outward inclined guide face 43 area and ports 480 over the inwards inclined guide face areas 44 or vice versa. Thereby it is obtained, that at power strokes the respective pocket 30 is communicated to the power channel D or E of higher pressure and the other pocket 30 of the same piston discommunicated from the power or high-pressure channel D or E. The device of these Figures is an example. The passages, lines, ports etc. can also be set in other places, when suitably designed and machined and when care is taken that they obtain the aim of this object of the invention. This embodiment of the invention is also described in "Q" of the summary of the invention. The passages 474 and 477 are the extension of the pockets 30 into the walls of the chambers. The fluid pressure pockets could in this embodiment also be completely located in the walls of the chambers 6, but to maintain them in the center of attack of the lateral forces it is better to keep the pockets in the pistons and set the delivery passages 474 and 477 accordingly. The collection chambers 473,478 may facilitate the radial distances of the passages 475,476,477 in order that the mentioned passages, ports and like can be easily and straight or under right angles become machined. The passages, lines and collection chambers and other means are provided with referentials at only one chamber 6 because they are similarily provided to the other chambers 6.

FIGS. 16 and 17 demonstrate by referential 610 the control body for radial flow, by referential 611 the rotor hub of rotor 612, by referential 613 the space which extends normal to the axis 614 of control body 601 through control body 610 and which contains moveably along the axis 615 of space 613 the thrust members 616 and 617 with their outer faces 618,619 with which they seal along the inner face 611 of the rotor 612 of "Z6" of the summary of the invention. The thrust chamber 613 between the thrust members 616 and 617 is filled with high pressure fluid through one-way valves 621,622 and fluid is passed to the balancing pockets of "Z6" of the summary of the invention which are shown by referentials 622 and 623 out of respective channels 624,625 over moveable seals 626,627 and passages 628 and 629. The thrust members 616 and 617 also form the control ports 630 and 631. By their thrust against the face 611 of the rotor 612 a tightly sealed flow to and from chambers 6 is obtained without any disturbance of the control- or closing archs 632 and 633 of the control body 610. This embodiment can also be applied in single-stroke devices and not only in multiple stroke devices.

The dotted lines 702 define or indicate the axial ends of the control ports 630,631 by way of example. Control body 610 may be provided with thrust chambers 690 to contain therein seals 691 which are to be pressed by the fluid in chambers 690 against the respective portions of face 611 of rotor 612 for closing and sealing the closing arcs between the low- and high-pressure areas of the device.

FIGS. 16 and 17 further demonstrate still another embodiment of the invention, namely the slide-shoe arrangement which is described in "Z4" of the summary of the invention. The piston 640 has a longitudinal axis through the radially extending passage 23 and a thereto normal second axis 650. Second axis 650 is thereby normal to the longitudinal axis in 23 of the piston and also parallel to the axis 614 of the rotor 612 or of the control body 610. A bore without referential number extends around the second axis 650 and the piston 640 carries in said bore the bar 641 which is usually a simple cylindrical bar. The ends of bar 641 extend out of piston 640 and carry on the ends of bar 641 the slide shoes 642 and 643. The slide shoes 642 and 643 are able to slide along the stroke guide end portions 51 and 52. The slide shoes 642,643 have in their radial outer faces the fluid-pressure pockets 87 to reduce the load and friction between the slide shoes and the stroke guides 51,52. The stroke guide faces are in this embodiment cylindrical inner faces to permit the simple outer faces of the slide shoes 642,643. Passages 23 and 20,647 are leading fluid under the pressure to that in the chamber 6 into the fluid pressure balancing recesses 87. The pressure in pockets 87 is high pressure at power strokes. Guides 646 may be provided in the device to prevent axial or other dislocation the bar 641 or of slide shoes 642 and 643.

In order to obtain the desire of the invention, namely to provide additionally active tangential fluid pressure balancing pockets 30 in the pistons, the shoes 642 and 643 are arrested by arresting means 644 to prevent rotation or excessive rotation of the slide shoes relatively to the bar 641. The effect thereof is, that under the gradually changing angle of pivotion of the slide shoes 642,643 along stroke guides 51,52, the shoes 642,643 are forcing the bar 641 to pivot in unison with the slide shoes 642 and 643. The bars 641 are thereby able to receive a flow control recess 29, whereby the flow of fluid under pressure through the second piston passages 31 into pockets 30 is obtained in timed relation to the pivotion of the slide shoes 642 and 643 and the embodiment of "Z5" of the summary of the invention is obtained. The other referentials again show parts, which are known from the earlier discussed Figures.

Dotted lines 701 show recesses which may be provided if so desired.

The embodiment demonstrated in FIGS. 18 and 19 is the stroke actuator with plural revolutions at each single rotor-revolution, which is discussed in "Z3" of the summary of the invention. Rotor 8 has working chambers 6. Pistons are not shown therein and piston shoes or slide shoes also not, because those already known from FIGS. 16,17,10,11 or from my mentioned patents may be inserted there. The stroke guide 11 has a concentric cylindrical outer face which is borne in bearing 675, whereby the stroke guide 11 is borne in bearing 675. Stroke guide 11 has also an eccentric inner face, which forms the guide face 42. It is cylindrical but eccentrically provided relatively to the bearing 675. Gearing means are provided to revolve the stroke guide 11 a plurality of revolutions at each single revolution of the rotor 8. Thereby the multiple strokes are provided and the device is thereby a multi-stroke device. The gearing means may be a matter of design or choice. The Figures however show an example of possible gearing means. Shaft 63 or rotor 8 may carry a first gear 679. The first gear 679 may over interim-gears 661,662,663 and shaft 681 drive the second gears 664 to engage the third gears 678 of stroke guide 11 to revolve the stroke guide 11 a plurality of revolutions at each time when the rotor 8 does one single revolution. Supports 660 and/or 668 may carry the bearing 675 or shafts of interim gears. An outgoing second gear 664 may drive another set of medial gears 666,667,668, to drive the fourth gear 669. Fourth gear 669 is attached to the control body 670 with passages 671 and 672 to revolve the control body 670 with suitable revolutions along control ports 673,674 for the control of flow of fluid into and out of chambers 6 in suitable timed relation and angular relation with the rotation of the rotor 8 and the multiple revolutions of stroke guide 11. Each piston assembled in one of the chambers 6 does thereby a plurality of power strokes and opposite non-power strokes at each revolution of the rotor 8 and the torque of the device as well as the flow quantity of fluid therethrough at each revolution of the rotor 8 is thereby multiplied compared to the typical single stroke per revolution device.

The embodiment of FIGS. 20 and 21 demonstrate the non-circular, for example rectangular cross-sectional area through a working chamber 706, which is described under "J" in the summary of the invention. The arrangement makes it possible to use the maximum of space through an axial size of rotor 708. While the cylinder uses only a small place in the neighbourhood of the next piston, the rectangular space of the device of these Figures permits a fullest possible utilization of the size of the rotor 708 to obtain a maximum of flow-through quantity of fluid through the rotor of a given size. That increases the torque and power of the device over that of common radial piston machines with cylindrical pistons and working chambers.

The non-circular or rectangular working chambers may be provided radially into the rotor 708 or they may be produced axially through a medial rotor portion 708, whereonto end portions 709,710 may be fastened to plane end faces 701 and 702. The pistons are receiving complementary cross-sectional areas to closely seal in the chambers 706 and to reciprocate therein.

Control bodies, for example, those like 610 of FIGS. 16 and 17 may have in respective beds 690 seal bodies 691 for the reduction or prevention of leakage from the high-pressure to the low-pressure side of the control body 610 over a respective control arch 631 thereof. When the chambers 6 are cylinders and have narrowed rotor passages, which are shown in others of the Figures, but not in FIG. 16, the axial extent of the thrust members 616,617 of FIGS. 16 and 17 can become shortened to the dotted lines 702 in FIG. 16. The fluid pressure pockets 622 and the thereto leading arrangements 628,62,626,627 can then be spared and be elimiated from the embodiment of the Figures. By such axial shortening of thrust bodies 616 and 617 and fthe elimination of the balancing pockets 622,623 the embodiment "Z8" of the summary of the invention will be obtained.

The bottom left Figure of FIG. 5 shows in the direction of arrows K—K a simplified transfer body without guides 39 and 40. The the remaining major necessities and portions are the radial strength providing neck 3, the ends or end portions 9, the medial portion 3 and the eccentricity 37 between the axes 4 and 38.

The upper right main part of FIG. 5 also shows the important outcuts 147 between portion 3 and ends 9. These outcuts 147 are required in order to obtain the long piston stroke for the high torques of the devices. These outcuts 147 are done in order that the rotor portions between referentials 117,18 and faces 113 and 114 of the left drawing of FIG. 3 can enter into the outcuts 147. If the outcuts 147 would not be provided in the tranfer body the mentioned portions of the rotor between 117, 18,113 and 114 could not enter the outcuts 147 and the transfer body could then not move partially into the rotor and outcuts 18. The piston stroke would then be limited to a stroke between the former art and the maxium stroke of the present invention. The "outcuts" are depressions or recesses.

Similar outcuts, similar to those of 147, can also be provided in the bars and slide shoes of FIG. 16 and they are shown there by the dotted lines 701. They are defined by the dotted lines as a possibility, but not as a must. These recesses 701 or 147 form the embodiment of "Z9" of the summary of the invention.

The piston shoes 83,84 of FIG. 10 form the embodiment "Z11" of the summary of the invention, and the cross-sectional view, cited by 83 in FIG. 11, which also show the center 4 of pivotion, define the embodiment "Z10" of the summary of the invention.

The embodiment of FIG. 22 demonstrates, that there are two or a plurality of cylinder groups 706 and 806 in the rotor 708. Since FIG. 22 has two cylinder groups with two groups of pistons therein, the transfer bodies of FIGS. 2 to 5 are in FIG. 22 extended through both piston groups wherefore the medial portions of the transfer bodies are respectively elongated. The speciality of this embodiment is, that a cylinder 706 in the first cylinder group 706 has an axis in radial direction through a plane face extending through the axis rotor 708 in the radial direction. Axially of the respective cylinder 706 is the cylinder of the second cylinder group, namely 806, located and the second respective cylinder has a radial axis located in the same radial face through the axis of the rotor 708 as the respective cylinder 706 has. Thereby the pivot centers of the pistons and tranfer bodies are in the same of said faces through the axis of the rotor. The feature of this arrangement is, that the pivot-centers of at least two pistons are located in an equal radial face or plane through the axis of the rotor. This makes it possible to insert a common transfer body through both cylinder groups. The common transfer body 2 engages at least two pistons, one piston 749 and one piston 849 by at least two pivot portions 703 and 3 provided on the transfer body. The pivot portions 703 and 3 are kept in the respective pistons 749 and 849. Thereby it is assured, that the pivot centers are in an axis in the mentioned same radial plane through a plurality of respective cylinders and pistons and in an axis in said plane parallel to the axis of the rotor. This prevents any deplacement of the transfer body from its parallelity to the axis of the rotor and to the cylinder groups. The guide portions 39 and 40 of the embodiment of FIG. 5 can thereby be spared in the embodiment of FIG. 22 and a safely operating common transfer body to a plurality of pistons in pluralities of cylinder groups in a rotor is obtained. The common transfer body 2 has on its medial portion a plurality of bearing portions, for example, 3 and 703 for the engagement of the bearing beds of the respective pistons 749 and 849. The bearing beds 45 of the pistons are part ball formed hollow spherical beds, while the bearing beds are part cylindrical in FIGS. 2 to 5 and in FIG. 25. The bearing portions 3 and 703 are part ball formed spherical portions in FIG. 22 while they are part cylindrical in FIG. 25. The part ball spherical means of FIG. 22 may be applied in FIGS. 2 to 5, or other Figures, if so desired.

Each cylinder group has a plurality of cylinders and each cylinder has its own radial plane through the axis of the rotor angularly spaced from the next radial plane of the same cylinder group; but each such radial plane through one of the cylinders has an adjacent cylinder of another piston group in its own radial plane through the rotor axis.

The embodiment of FIG. 22 in combination with the thereto belonging cross-sectional FIGS. 23 and 24 further demonstrates a control body arrangement for multi stroke radial motors which is self-sealing because it is axially moveably provided in a space in the housing portion and thrust towards the end face of the rotor by fluid pressure in at least one thrust chamber of two thrust chambers formed on shoulders on the other end of the control body.

The rotor 708 has at least one end face-or two-which forms the rotary control face whereinto rotor passages 64 port and which communicate through respective portions of the rotor to the respective cylinders of cylinders 706 or 708. The control body 704,804 has on its front end the stationary control face, which is sealing along the mentioned rotary control face, because it is laid therealong and pressed thereagainst. The stationary and rotary control faces form together the control mirror 741,841 consisting of a rotary face sliding along a stationary face and both faces are closely together to slide relative to each other and seal against excessive loss of fluid through them, along each other.

The housing 61 forms a flow control portion 727,827 with entrance- and exit ports 721,722 or 821,822. In the respective flow control portion 727,827 a hollow space is provided with three different diameters. Thereinto the respective control body 704,804 is inserted. The control body 704,804, which has the stationary control face of mirror 741,841 on its front end, forms a first shoulder portion with a first outer diameter 705,805 which fits in the first inner diameter of the three diameters of the mentioned space. On the other end the control body 704,804 forms a third shoulder with a third diameter 707,807 which fits in the third inner diameter of the mentioned hollow space. Therebetween a medial shoulder is provided on the control body with a second outer diamter 706,806 which fits in the medial second inner diameter of the mentioned hollow space. The fits are of such nature, that they are sealing between the control body and the housing portion, but that the control body remains moveable in axial direction parallel to the rotor axis within the mentioned hollow space. Arresters engage in arresting beds 731 to prevent rotation of control body 704,804 in the mentioned hollow space.

By this arrangement two fluid pressure or fluid containing chambers 701 and 702 or 801 and 802 are formed between the housing portion and the control body. Port 721,821 leads to chamber 701,801 and port 722,822 leads to chamber 702,802.

The axial end portions 9 of the body 2 may carry rollers 36 to roll along the guide faces 52,53, for example, of housing 61. The first thrust chamber 701,801 is formed between the medial shoulder and the first or bigger shoulder with outer diamter 705,805. The second thrust chamber 702,802 is formed between the medial or second shoulder with outer diamter 706,806 or third shoulder with outer diameter 707,807.

The control body 704,804 forms in its front end the first control ports 712 and the second control ports 713 or 812 and 813 respectively. When ports with end digits 12 act as entrance ports, the ports with end digits 13 act as exit ports and vice versa. There are as many ports with end digits 12 and 13 as there are strokes and inclined guide faces provided in the device. One port with end digit 12 between two ports with end digits 13 and one port with end digit 13 between two ports with end digits 12. From the first control ports 713,813 extend first channels 713,813 through a portion of the control body in the first thrust chamber 701,801. From the second control ports 812 extend second channels 712,812 into the second thrust chamber 702,802. The first diameter may also be called the outer diameter 705,805, the second diameter may also be called the medial diameter 706,806 and the third diameter may also be called the inner diameter 707,807 of the control body.

The pressure in the fluid in at least one of the thrust chambers 701,801 or 702,802 presses the control body 704,804 towards the rotor and thereby provides the tight seal between the rotary and stationary control faces of the control mirror 741,841.

Thereby flow of fluid is passed from the entrance port through one of the thrust chambers and through all of the first or second channels and control ports into passages 64 and into cylinders with outwards moving pistons. The exit fluid flows out of cylinders or chambers with inwardly moving pistons through the respective passages 64 into and through all of the second or first control ports and passages into and through the other of the thrust chambers and then through the exit port of the device. For reversed flow direction the ports are reversed from exit to entrance ports and vice versa.

Correct dimensioning of the thrust chambers provides a very effective control body 704 or 804.

End chamber 703,803 commonly contains low- or no-pressure. The further referential numbers in these figures show parts which are equal in substance to those with equal referential numbers in other Figures of the specification.

The embodiment of FIG. 25 corresponds fully to that, of FIG. 22 with the exception that the bearing beds and transfer body bearing portions are of part cylindrical configuration in FIG. 25 while they are part ball formed in FIG. 22. Consequently in FIG. 25 the transfer body 2 has two or multiple bearing portions, pivot portions, 3 and 703 of part cylindrical bars. They are borne in the part cylindrical hollow bearing beds of the pistons 749 and 849 and they pivot therein similar as the transfer body 2 of FIG. 2 pivots in the piston of FIG. 2. FIG. 25 also shows the fluid pressure pockets or recesses 47 in the pivot portions of the transfer body 2.

While these fluid pressure pockets 47 are not shown in FIG. 22, they are shown in FIGS. 22A and 22B, because otherwise the control of the passing of fluid into the fluid pressure pockets 30 of the pistons 749 and 849 might not be properly provided. If the fluid pressure pockets 30 are not provided in the pistons 749 and 849 or if the control and passing of fluid under pressure into them is not properly secured, the lateral forces on the pistons would in the long stroke devices of the invention become so very high that great friction or welding might occur along the outer faces of the pistons. If no fluid pressure pockets 47 are provided the load between the pivot portion and the piston bed would exceed the permissible limits. Great friction would then appear and the faces of the pivot portion and of the pivot bed or bearing bed might weld.

The housing 61 of FIGS. 22 and 25 is axially elongated respective to the other Figures with single piston groups. The housing 61 of FIGS. 22 and 25 is thereby the axially elongated guide 11 of FIG. 2

The radial extensions 15,16 with the faces 13,14 of FIG. 3 are also provied on the rotors of FIGS. 22 and 25. The rollers 36 and ends 9 of the transfer bodies 2 of FIGS. 22 and 25 correspond to those of FIGS. 2 to 5, whereby the rollers 36 of FIGS. 22 and 25 roll along the inclined guide faces 43 and 44 of stroke guide end portions 52 and 53 of the stroke guide 11 of FIG. 2. See hereto the descriptions of FIGS. 2 to 5 which also apply to FIGS. 22 and 25 since FIGS. 22 and 25 are provided with the means of FIGS. 2 to 5.

The two separately inventive arrangements of the last embodiment of FIGS. 22 to 25 may also be described in short, as follows:

In a radial piston device in combination: a housing, a rotor rotatably mounted in said housing, working chambers in said rotor, pistons reciprocable in said working chambers and along wall faces of said working chambers, inlet channels and outlet channels communicated to said chambers and to said housing, a stroke guide provided in said housing and radially of said chambers and pistons for the guidance of the strokes of said pistons, stroke transfer bodies mounted between said pistons and said stroke guide, control means for the control of flow of fluid to and from said working chambers, and multiple inward and outward guide faces on said stroke guide to guide said reciprocable pistons a plurality of times inward and outward in said chambers along said wall faces at each revolution when said rotor revolves;

wherein fluid pressure pockets are provided in the direction of a lateral load of said pistons, wherein said fluid pressure pockets are located between peripherial outer portions of said pistons and portions of said wall faces, wherein stroke transfer bodies are pivotably borne on bearing beds on said pistons to permit pivotion of said bodies around center axes which are normal to the axes of said pistons and parallel to the axis of said rotor, wherein said stroke transfer bodies have ends with an ability to move along said outward and inward guide faces of said stroke guide, while said ends have portions with second axes parallel to said center axes but eccentrically distanced therefrom, wherein said pivotion runs through angles of pivotion between pivot angle limitations which are formed by said bodies and said pistons, wherein control portions are provided on said stroke transfer bodies and control flow passages are provided on said pistons to control the flow of fluid into said pockets, wherein said control portions alternately open and close said passages in dependency of said angles of pivotion and thereby in timed relation to the movement of said stroke transfer bodies along said outward and inward guide faces of said stroke guide, wherein said working chambers form at least two cylinder groups, while said pistons from piston groups in said cylinder groups;

wherein each cylinder of the first cylinder group is located axially of a respective cylinder of a second cylinder group, whereby each two cylinders of the two cylinder groups have radial axes in equal radial planes of said rotor, and, wherein said transfer bodies extend through at least two cylinder groups to form common transfer bodies for at least two pistons in a respective plane of said equal radial planes, whereby said cylinders guide said pistons and said pistons guide said transfer bodies to maintain the location of the axes of the ends of said transfer bodies in equal radial planes through the axis of said rotor.

And; as:

In a multiple stroke radial chamber device in combination, a housing, mounting therein a revolvable rotor and piston stroke guides with multiple inward and outward guide faces; cylinders radially arranged in said rotor with pistons reciprocable in said cylinders; and inlet and outlet passages to and from said cylinders;

wherein said housing includes a flow control portion and said rotor forms an end face whereinto said passages port;

wherein said control portion contains three hollow spaces of different inner diameters, wherein a control body is inserted into said hollow spaces, axially moveable in said hollow spaces, prevented from rotation in said hollow spaces, provided with three portions of different outer diameters which fit and sealing along said inner diameters of said hollow spaces, whereby said spaces and said control body form two separated fluid pressure chambers in two of said spaces between wall portions of said spaces and two portions of said portions of said control body, wherein inlet port means are communicated through said housing to one of said chambers and outlet port means to the other of said chambers;

wherein said control body forms a control face with control ports capable of sealing and sliding along said end face, and, wherein first channels extend from first ports of said control ports through a portion of said control body to the end of the portion of said control body between the outer and the medial diameter of said outer diameters and second channels extend from second ports of said control ports through a portion of said control body to the end of the portion of said control body between the medial and inner diameter of said outer diameters of said control body, whereby said one of said chambers is communicated to said first ports and the said other of said chambers is communicated to said second ports of said control ports for passing fluid to and from said passages and said cylinders and said control body is pressed by high pressure fluid in at least one of said chambers toward said rotor to seal said faces.

FIG. 22-A shows a portion of FIG. 22 in a cross sectional view along the arrowed line XXII-A of FIG. 22. FIG. 22-B is the cross sectional view through FIG. 22-A along the arrowed line in FIG. 22-A, FIG. 25-A is a cross-sectional view through FIG. 25 along the arrowed line XXV-A and FIG. 25-B is a respective view along the arrowed line XXV-B of FIG. 25. These Figures show in their respective views the rotor 15,708; the piston 49, portions of the transfer body 2 with neck 222 and bearing portion 3. The passages 23 extend from the cylinder 6,706,806 through piston 49 to port into the pivot bed in piston 49 which bears the bearing portion 3 of the transfer body 2. Bearing portion 3 is provided with the control recess(es) 29,47 for the periodic communication and closing of control fluid passages 31 to fluid pressure pockets 30 in the pistons. These are closed by close fit and slide along the wall faces of the rotor portions 15 and 16. The transfer body 2 has the passages 22,20 to the fluid pressure pockets 35 in the axial end portions of the transfer body. These end portions 9 carry the rollers 36 which roll along the inward and outward inclined piston stroke guide faces 42,43,44 of the stroke guide 11 in housing 11. The rotor passages 64 are seen in FIG. 25-A and control body passages 712 and 713 are seen in FIG. 25 B which also shows the shaft 63.

In FIG. 25-A and B the stroke transfer body has its neutral, not pivoted, position because the sectional view through FIG. 25 shows the piston in the outermost position at which the rollers are likewise in their position of outermost travel with respect to the stroke guide 11. The transfer body neck 222 shows in FIG. 25-A that it has the pivot limitation face(s) 12 which limit the pivotal movement when they touch the pivot limitation faces 1 on the piston. Shown in FIGS. 25-A and B are also the concentric center axis 4 of the pivotal movement of bearing portion 3 and the therefrom by the distance d=37 distanced eccentric axis 38 through the axial end portions 9 of the transfer body 2. If now the rotor revolves and the rollers 36 roll along the guide faces 42,43,44 than the lateral component of forces of the rollers presses the eccentric axis 38 laterally away by which the bearing portion 3 is forced to pivot in the piston until the limitation face 12 meets the limitation face 1 at which the pivotal movement is stopped. At this position of pivotion the respective control recess 29,47 opens the communication between the passages 23 and 31 whereby fluid is led from cylinder 6,706,708 into the respective fluid pressure pocket 30 to bear by the fluid pressuree in this pocket the lateral load of the piston and to force the oppositional directed component of fluid pressure in this pocket against the respective wall portion 15 or 16 respectively of the rotor 15,708. The action is similar in FIG. 22-B. FIG. 22-A is written in an enlarged scale relative to FIG. 22 in order to permit the presence of dotted lines to indicate the locations of recesses 29,47 and of passages 20 and 22 in the stroke transfer body. These recesses and passages have not been shown in FIG. 22 because FIG. 22 is in a smaller scale and has no space for the writing of these passages and recesses in the Figure.

In FIG. 26 a piston 949 is axially moveable in a cylinder 906. Fluid is pressed through entrance 964 into the cylinder. The high pressure fluid presses the piston upwards. The arrangement may be a jack or lifter for lifting a car, a press or the like. In this case every engineer will agree that the lifting of the piston and the thrust from below the piston against the piston is exclusively done by the fluid pressure pocket, namely by the fluid in the cylinder. No mechanical means are provided inside of the cylinder. The only mechanical means would be the power plant with the fluid flow creating means which transfers the high pressure fluid through passage 964 into the cylinder 906. Nobody would ever assume, that the piston 949 would be lifted mechanically, but every educated artisan would agree that the piston is lifted or pressed hydraulically, namely by the fluid pressure pocket below the piston 949 in the cylinder 915.

In FIG. 27 a portion of the rotor with cylinder, piston and transfer body of the invention is shown in a sectional view in a slightly larger scale. In it the transfer body has its neutral, not pivoted, position which is indicated thereby that the roller which is visible in the framed sectional portion in the middle of the stroke transfer body's neck meets the not inclined neutral portion of the stroke guide between the peripherially thereof beginning inclined piston stroke guide faces. The high pressure fluid which is led through the fluid supply passage into the cylinder now presses against the bottom of the piston and thereby the piston upwards in the same manner as it was done in FIG. 26. There is no doubt that every engineer will agree that the piston in FIG. 27 is lifted upwards exclusively by the fluid pressure pocket below the bottom of the piston, namely by the fluid in the cylinder. The Figure also shows that the pivot axis is the concentric center axis of the pivot portion or bearing portion of the stroke transfer body and that the roller(s) runs around an eccentric axis which is radially inwardly distanced by the distance "D" from the concentric axis. The concentric axis is named here the pivot axis and the eccentric axis is named here the roller axis. Since the roller in this angular position of the rotation of the rotor is prevented from any upwards movement by the horizontal face portion of the stroke guide between the inclined inward and outward stroke guide face portions, the piston can not move upwards. The high pressure fluid presses the piston strongly on its bottom and the eccentric or roller axis is thereby forced into position exactly radially below the concentric pivot axis. The transfer body is forced to stay with its neck straightly upwards in its neutral, unpivoted, position. At this position the limitation faces 1,12, and 7 and the pivotion limiter 5 are clearly visible.

If now the rotor revolves a few degrees and the angular position of FIG. 30 is obtained at which the roller(s) rung along an outward inclined guide face portion—as in FIG. 30- the high pressure fluid in the cylinder can force the piston upwards because the piston can now move upwards. Since a motor which with its shaft has to drive something the means which is to be driven provides a resistance against the rotation of the rotor, the rotor provides this resistance against the anti clock wise movement of the rotor in FIG. 30. The force from below the bottom of the piston in combination with the inclination of the outward stroke guide face now strongly forces the roller axis leftward in FIG. 30 compared to FIG. 27. The transfer body inclines thereby as shown in FIG. 28. Herein the right end of the neck of the transfer body meets the limitation face 1 by neck face 12 with 1 the limitation face on the inside of the piston portion and 12 the respective limitation face of the neck of the transfer body. Important here is, that the transfer body would not pivot into this position and could not be forced to do any pivotal movement if the stroke guide face would not be inclined, if no high pressure fluid would be below the bottom of the piston and if the roller axis would not be distanced by the distancxe "D(or "d") from the pivot axis. Thus, these three means are essential to obtain the aim of the present invention.

The pivotal movement may start and carried out suddenly when the roller starts to meat the inclined portion of the stroke face. Sharp edges of the stroke face will make sudden pivotions while rounded edges will permit a slower pivotal movement of the transfer body. Considering sharp edges of the guide faces a sudden pivotion would appear which would result in a sudden hammer blow like meeting of the limitation faces 1 and 12. In this respect the distance "D"=37 between the pivot axis and the roller axis is important. A big distance will provide a strong hammer blow while a short distance will soften such sudden hammer blow and will lay the limitation faces 1 and 12 softer together. Considering, for example, a pressure of 100 atmospheres (which is a low pressure because the inventor has just completed a 1500 atmospheres water pump with high efficiency) and considering the diameter of the piston to be 3.56 centimeter diameter which corresponds to a cross sectional area of 10 square centimeter, the force of the fluid pressure pocket below the piston would be 10 square centimeter multiplied by 100 atmospheres=1000 kilograms. A distance "D"=1 cm would then provide a moment of torque onto the transfer body of 1000 kilogram mauliplied by 1 cm=1000 kilogram centimeter or 10 kilogram meter mulitlied by the tangent of the pivot angle gamma of FIG. 29. The pivot angle is defined by the angle between the mentioned limitation faces 1 and 12. The just found basic moment of 10 kilogram meter is a very high moment and would result in a strong hammer blow. If the distance "D" between the mentioned axes would be only 1 millimeter then the moment would be ten times smaller and the hammer like blow would be so weak that it can not disturb the neck or the limitation portion 5 of the transfer body or the respective portions of the piston. Thus, the distance "D" (or d=37) between the mentioned pivot and roller or concentric and eccentric axes is an important means to soften or strengthen the moment which enforces the pivotion of the transfer body. The relative sudden stop of the pivotal movement of the transfer body is regrettable but can at the present stand of technology not easily be prevented because there are no other means presently known which could provide and control a pivotal movement of the transfer body in a multiple piston strokes device with multiple inclined inward and outward guide faces per revolution of a rotor. Such devices with multiple strokes per revolution, are, however, low speed devices, especially low speed motors since for higher rotary speeds the motors with angular piston stroke guide faces are used. At such low speed motors as here discussed in this invention, the angular velocity of the rotor is rather small and the time of the pivotal movement is respectively long, so, that the stopping of the pivotal movement by the meeting of the limitation faces 1 and 12 can be accepted and will not decrease the life time of the device, if the guide faces and the distance "D" as well as the pivot angles "gamma" are formed accordingly.

FIG. 29 illustrates that the resulting force "R" brings a vertical component "Cv" and a lateral component or horizontal component "Ch" by the angle of pivotion="gamma". Ch will be R sind gamma and Cv will be R cos gamma. With these values it can be calculated to keep Vh small enough not to disturb the neighboring portions of the pivot portion of the transfer body.

FIG. 30 corresponds in principle to FIG. 2-B. It is, however, written in a slightly bigger scale. How the distance "D" actuates the pivotal movement of the transfer body by the forces play between the high pressure fluid in the pocket below the piston, which is the fluid in the cylinder and the location of the roller on the respective portion of the piston stroke guide face(s) is already explained at hand of FIGS. 28 and 29. The pivotal movement into the pivot position as shown in FIGS. 2-B, 28,29 and 30, brings also the communication of the cylinder via the passages in the piston and the control recess(es) in the pivot portion of the transfer body to the lateral fluid pressure pocket 30 of the piston. In the cylinder is now the high pressure fluid. It has the forces of the arrows in FIG. 30. These forces are directed against the bottom of the piston in upwards direction and onto the bottom of the cylinder in downward direction. In short, the piston is now a ram as in FIG. 26 and it is forced radially outward axclusively by the force in the flow below the bottom of the piston. The high pressure is transferred into the fluid pressure pocket below the roller and bears the roller revolvably on the end portion 9 of the transfer body. In this pressure pocket below the roller (or between the inner face of the roller and the respective end portion of the transfer body) again the fluid forces act in the directions of the arrows therein. One direction against the inner face of the roller and the opposite direction against the end portion of the transfer body. The high pressure fluid is also communicated to the lateral pressure pocket 30 in the piston to form therein the directions of forces of the arrows therein. One direction against the piston and the opposite direction against the respective portion of the wall of the cylinder.

The forces in the pockets, including the cylinder as a pocket, can be assumed to act concentrated in single points for a mathematical evaluation. This is illustrated in FIG. 32. The resulting force on the piston is the force "F" built up by the upwards component Fs=component of stroke from the bottom of the piston and the component "−Ft" from the lateral pocket 30 onto the piston. The angle "delta" lies betwen F and Fs and is taken from the difference of 90 degrees minus the angle of inclination "tau" of the inward and outward stroke guide face 42,43,44. These forces bring the piston into equilibrium. The piston floats between these forces and does not thrust against anything except against the pivot portion of the transfer body if the forces are clearly kept as in FIG. 32. The forces component Ft now is the force which provides the torque onto the wall of the cylinder of the rotor and thereby to the shaft. Note, that −Ft is the direction against the piston while positive Ft is the direction against the respective portion of the wall of the cylinder. In the simplified schematic of FIG. 31 the forces in the pockets of FIG. 30 are shown again. The forces in the pocket between the roller and end portion of the transfer body are diametrically balanced. This fluid pressure pocket appears small but that is because there are two such pockets, one in each end portion of the transfer body. Consequently the pocket and its forces appear in half size. Fs is in FIG. 31 the force of the fluid in the pocket below the piston (in the cylinder) against the piston and Ft is in this Figure the force out of the lateral pocket 30 against the respective portion of the wall of the cylinder. Since the piston is force balanced between Fs, F and −Ft the piston is not pressed against any wall portion of the cylinder. The only single and exclusive force which meets a portion of the rotor (for the shaft) is the fluid pressure forces component Ft out of the lateral pocket 30 in the piston. This fluid acts here similar as on the bottom of the piston of FIG. 26. Thus, it is exclusively the high pressure in fluid pocket 30 which transfers torque of the motor when fluid is led under pressure into the respective cylinder. However, this transfer of torque onto the rotor of the motor, is done only in the arrangement of the entirety of the piston, cylinder, transfer body, its pivotion and the reaction force of the inclined guide face portion. Thus rearwardly borne by the rollers, transfer body and piston, the high pressure in the fluid pocket 30 transfers the torque of the motor of the invention; it presses the wall portion of the cylinder leftward as the piston is pressed upwards in the jack of FIG. 26.

What is claimed is:

1. In a radial piston device in combination: a housing, a rotor rotatably mounted in said housing, working chambers in said rotor, pistons reciprocable in said working chambers and along wall faces of said working chambers, inlet channels and outlet channels communicated to said chambers and to said housing, a stroke guide provided in said housing and radially of said chambers and pistons for the guidance of the strokes of said pistons, stroke transfer bodies mounted between said pistons and said stroke guide, control means for the control of flow of fluid to and from said working chambers, and multiple inward and outward guide faces on said stroke guide to guide said reciprocable pistons a plurality of times inward and outward in said chambers along said wall faces at each revolution when said rotor revolves;

wherein fluid pressure pockets are provided in the direction of a lateral load of said pistons, wherein said fluid pressure pockets are located between peripheral outer portions of said pistons and portions of said wall faces, wherein said stroke transfer bodies are pivotably borne on bearing beds on said pistons to permit pivotion of said bodies around center axes which are normal to the axes of said pistons and parallel to the axis of said rotor, wherein said stroke transfer bodies have ends with an ability to move along said outward and inward guide faces of said stroke guide, while said ends have portions with second axes parallel to said center axis but eccentrically distanced therefrom, wherein said pivotion runs through angles of pivotion between pivot angle limitations which are formed by said bodies and said pistons, wherein control portions are provided on said stroke transfer bodies and wherein said control flow passages are provided on said pistons to control the flow of fluid, wherein said control portions alternately open and close said passages in dependency on said angles of pivotion and thereby in timed relation to the movement of said stroke transfer bodies along said outward and inward guide faces of said stroke guide, wherein said working chambers form at least two cylinder groups, while said pistons form piston groups in said cylinder groups;

wherein each cylinder of the first cylinder group is located axially of a respective cylinder of a second cylinder group, whereby each two cylinders of said two cylinder groups have radial axes in equal radial planes of said rotor, and, wherein said transfer bodies extend through at least two cylinder groups to form common transfer bodies for at least two pistons in a respective plane of said equal radial planes, whereby said cylinders guide said pistons and said pistons guide said transfer bodies to maintain the location of the axes of the ends of said transfer bodies in equal radial planes through the axis of said rotor.

2. The device of claim 1, wherein said housing includes a flow control portion and said rotor forms an end face whereinto rotor passages port, which communicate through portions of said rotor to respective cylinders of said cylinder groups, wherein said control portion contains three hollow spaces of different inner diameters, wherein a control body is inserted into said hollow spaces, axially moveable in said hollow spaces, prevented from rotation in said hollow spaces, provided with three portions of different outer diameters which fitting and seal along said inner diameters of said hollow spaces, whereby said spaces and said control body form two separated fluid pressure chambers in two of said spaces between wall portions of said spaces and two portions of said portions of said control body, wherein inlet port means are communicated through said housing to one of said chambers and outlet port means to the other of said chambers;

wherein said control body forms a control face with a plurality of control ports capable of sealing and sliding along said end face, and, wherein first channels extend from first ports of said control ports through a portion of said control body to the end of the portion of said control body between the outer and the medial diameter of said outer diameters and second channels extend from second ports of said control ports through a portion of said control body to the end of the portion of said control body between the medial and inner diameter of said outer diameters of said control body, whereby said one of said chambers is communicated to said first ports and of the said other of said chambers is communicated to said second ports of said control ports for passing fluid to and from said rotor passages and said cylnders and whereby said control body is pressed by high pressure fluid in at least one of said chambers toward said rotor to seal said faces.

3. The device of claim 1, wherein said stroke transfer bodies extend axially in both directions beyond said pistons, to form stroke transfer ends, wherein said ends form pairs of bearing portions, while said bearing portions of each pair form one forwardly located bearing portion and one rearwardly located bearing portion, and each of said bearing portions carries a rolling member, whereby four rolling members associated to each respective piston and transfer body are rolling along pairs of inward and outward guide faces of said stroke guide in order to define by said rolling under the influence of the configuration of said guide faces of said stroke guide the inclination of pivotion of said transfer bodies and thereby provide and control said flow of fluid into said pockets and said action in said timed relation of said control portions.

4. The device of claim 1, wherein said stroke transfer bodies have ends which carry members with an ability to move along said outward and inward guide faces of said stroke guide.

5. The device of claim 4, wherein said members are laterally distanced from the respective longitudinal axis of the respective piston of said pistons.

6. The device of claim 1, wherein said inward or outward guide faces of said stroke guide form angles of inclination relative to the radial axes of said working chambers in the range of twenty to sixty degrees, and, wherein fluid pressure pockets provided along portions of the outer faces of said pistons and the wall faces of said chambers are suitably sized and located to be able to carry the major portion of the tangential load transferred from said inward and outward guide faces of said stroke guide to said pistons, whereby said device is able to handle an extremely high torque by said rotor in a given weight and size of the device.

7. The device of claim 6, wherein said fluid pressure pockets are suitably dimensioned and located to permit said device to handle said extremely high torque at a high efficiency.

8. The device of claim 1, wherein said stroke transfer bodies have ends of cylindrical outer faces to carry thereon revolvable rollers which roll with their outer faces along said guide faces of said stroke guide, and, wherein fluid pressure pockets are provided in said ends, extending through said cylindrical outer faces into said ends of said transfer bodies, while said fluid pressure pockets in said ends are provided on said ends in a radial outward direction with respect to the neutral, not pivoted position of said transfer bodies, whereby said fluid pressure pockets in said ends pivot with said transfer bodies and thereby act at all times when they are communicated through said control portions to said passages in a direction which is substantially equal and opposed to the direction of the load which appears on said rollers during said power strokes.

9. The device of claim 8, wherein said bearing portions are provided with flow-control recesses which interrupt said bearing faces, wherein said pistons are provided with first passages to extend from said working chambers through said pistons into said recesses, wherein said passages are provided through portions of said pistons to extend from said bearing beds to said pockets, wherein said second passages are located at definite places in order that said control recesses are able to alternately open and close said second passages when said bearing portions pivot in said beds, and, wherein said flow-control recesses communicate said first and second passages when said pistons do power strokes when they oscillate in said working chambers;

whereby the lateral forces acting during said power strokes on said pistons are at least partially carried by pressure in fluid in said pockets when said passages are communicated by said recesses.

10. The device of claim 9, wherein said flow control recesses communicate said first and second passages through said piston and thereby said pockets with said working chambers when said pistons do outward strokes at said reciprocation in said working chambers, wherein fluid under pressure is led into said working chambers during revolution of said rotor at times of angular location of said working chambers and pistons below said outward guide faces of said stroke guide, whereby said fluid under pressure forces said pistons in said chambers outward and said stroke transfer bodies along said outward stroke faces to revolve said rotor, whereby said device acts as a motor, and, wherein said pockets transfer the force and high pressure fluid against the respective portions of said wall faces.

11. The device of claim 4, wherein said rotor is provided with radial extensions, wherein said rotor has radially reduced outer diameters endwards of said extensions, wherein said extensions form extended working chamber wall-faces to form thereby extended piston-stroke guide faces, and, wherein the outer faces of said pistons are at least partially and temporarily moved and guided along said guide faces of said radial extensions.

12. The device of claim 11, wherein said extensions extend between endwards located faces of said outward and inward guide faces partially beyond said guide faces into a space provided between portions of said stroke guide and said endwards located faces.

13. The device of claim 11, wherein said wall face portions form piston-guide- and support-faces, whereby they also form torque- and power-reception faces, said extensions and segments of said rotor form torque-transfer portions and said fluid pressure pockets form torque-thrust- and transfer-means.

14. The device of claim 11, wherein said stroke guide includes a medial portion and end portions on the ends of said medial portion, wherein said guide faces of said stroke guide are provided on said end portions, wherein said medial portion provides a recess extending beyond said guide faces radially into said stroke guide, wherein said radial extensions of said rotor at least temporarily enter into said recess in said medial portion, wherein said stroke transfer bodies have medial parts and end parts on the ends of said medial parts, wherein said medial parts include power-transfer centers, wherein said power transfer centers are located in said pistons and at the major portion of the strokes of said pistons between said radial extensions of said rotor, and, wherein said end parts of said stroke transfer bodies carry engagement means to engage said guide faces of said stroke guide and to guide said power transfer bodies and said pistons substantially parallel to said outward and inward guide faces of said stroke guide.

15. The device of claim 14, wherein said engagement means are rolling rings with cylindrical inner and outer roller faces, wherein said end parts are cylindrical bars with cylindrical outer faces of a configuration complementary and fitting to said inner faces of said rolling rings, wherein said end parts of said stroke transfer bodies contain fluid pressure pockets communicated by passages through portions of said stroke transfer bodies to said medial part and through said medial part to a space which contains fluid under pressure, whereby said outer roller faces roll along said guide faces and said inner roller faces slide along said end parts and are at least partially radially borne by pressure in fluid in said pockets in said end parts of said stroke transfer bodies.

16. The device of claim 1, wherein said stroke transfer bodies include bearing faces of a configuration complementary to the configuration of said bearing beds, and, wherein said bearing faces are slidingly borne on said bearing beds.

17. The device of claim 16, wherein said bearing faces are shorter than the diameter of the pistons;

wherein said bearing faces are provided on bearing portions of said stroke transfer bodies, wherein said bearing portions are shorter than the diameters of said pistons, and, wherein said bearing portions and said bearing faces are located within the outer diameters of said pistons.

18. The device of claim 17, wherein said bearing portions and said bearing beds at least partially and temporarily enter into said working chambers in order to provide the possibility of large piston strokes.

19. The device of claim 16, wherein said bearing beds are provided with radially outwardly extending face portions, wherein said pistons are provided with radially outwardly extending piston portions, wherein said face portions are partially provided on said piston portions, wherein said bearing portions of said stroke transfer bodies are provided with radially extending necks, wherein said radially extending necks are partially narrower than the distance between said radially extending face portions, and, wherein said necks are able to pivot in a limited extent between said face portions of said piston portions.

20. The device of claim 19, wherein said necks and their configurations in combination with said face portions and said piston portions define definite limits of the angles of pivotion of said necks between said face portions, and, wherein said necks are kept by said face portions and said piston portions in their maximums of pivot directions when said stroke transfer bodies are moving along a respective outward guide face of said stroke guide, whereby said maximums of pivot directions are maintained by said stroke transfer bodies at said moving along said respective outward guide face.

21. The device of claim 19, wherein said stroke transfer bodies and said necks are utilized to define and actuate said control portions for said control of flow of fluid into said pockets.

22. The device of claim 19, wherein said stroke transfer bodies carry members which move along said guide faces of said stroke guide, wherein said transfer bodies and said pistons have a center of pivotion, wherein said members which move along said faces are mounted around a radially inner axis of parallelity to the axis of said rotor, and, wherein an eccentricity extending radially inward from said center of pivotion is provided between said center of pivotion and said radially inner axis.

* * * * *